US009480898B2

(12) United States Patent
Bae

(10) Patent No.: US 9,480,898 B2
(45) Date of Patent: Nov. 1, 2016

(54) MULTIPURPOSE PUTTING PRACTICE DEVICE FOR ENABLING STRAIGHT PUTTING AND DISTANCE PRACTICE BY SITUATION

(71) Applicant: BARO PUTTING CO., LTD, Suncheon-si, Jeollanam-do (KR)

(72) Inventor: Cheol Seong Bae, Suncheon-si (KR)

(73) Assignee: BARO PUTTING CO., LTD., Suncheon-si, Jeollanam-do (KR)

( * ) Notice: Subject to any disclaimer, the term of this patent is extended or adjusted under 35 U.S.C. 154(b) by 0 days.

(21) Appl. No.: 14/950,737

(22) Filed: Nov. 24, 2015

(65) Prior Publication Data

US 2016/0074736 A1 Mar. 17, 2016

Related U.S. Application Data

(63) Continuation of application No. PCT/KR2015/003558, filed on Apr. 9, 2015.

(30) Foreign Application Priority Data

Apr. 17, 2014 (KR) ..... 10-2014-0045861
Sep. 17, 2014 (KR) ..... 10-2014-0123621
Apr. 1, 2015 (KR) ..... 10-2015-0046209

(51) Int. Cl.
*A63B 67/02* (2006.01)
*A63B 69/36* (2006.01)

(52) U.S. Cl.
CPC ..... *A63B 69/3676* (2013.01); *A63B 69/36* (2013.01); *A63B 67/02* (2013.01); *A63B 2067/025* (2013.01); *A63B 2208/0204* (2013.01)

(58) Field of Classification Search
CPC ..... A63B 67/02; A63B 2067/025; A63B 69/3676; A63B 2071/0694; A63B 2063/001; A63B 69/3661; A63B 2220/18
USPC ..... 473/157–166, 181, 190
See application file for complete search history.

(56) References Cited

U.S. PATENT DOCUMENTS 1,759,156 A * 5/1930 Fish ..... A63B 69/0079 473/143
3,215,436 A * 11/1965 Carter ..... A63B 69/3661 264/54

(Continued)

FOREIGN PATENT DOCUMENTS

KR 20-0220560 Y1 4/2001
KR 20-0292134 Y1 10/2002

(Continued)

*Primary Examiner* — Mark Graham
(74) *Attorney, Agent, or Firm* — Novick, Kim & Lee, PLLC; Sang Ho Lee; Jae Youn Kim

(57) ABSTRACT

Provided is a multipurpose putting practice device for enabling straight putting and distance practice by situation, which: enables short-distance or middle- and long-distance putting practice on flat, uphill, and downhill environments; enables a golf ball to be collected at the same place where putting is carried out through an upwardly protruding putting line during putting;
improves positioning by checking whether a golf ball has gone into the hole by sound and with the naked eye so as to hit the golf ball to a target spot in a fixed direction; and forms correct putting postures, and digitizes and visualizes a plurality of green speeds such that a user can compare and figure out the plurality of green speeds and practice distance adjustment on a desired field.

14 Claims, 25 Drawing Sheets

(56) References Cited

U.S. PATENT DOCUMENTS

| | | | | | |
|---|---|---|---|---|---|
| 4,344,624 | A * | 8/1982 | Laursen | A63B 69/3676 | 473/159 |
| 4,875,682 | A * | 10/1989 | Paolillo | A63B 67/02 | 206/315.9 |
| 5,129,653 | A * | 7/1992 | Morris | A63B 67/02 | 473/184 |
| 5,431,403 | A * | 7/1995 | Pelz | A63B 67/02 | 473/160 |
| 5,586,941 | A * | 12/1996 | Klearman | A63B 69/3676 | 473/160 |
| 5,595,543 | A * | 1/1997 | Wolk | A63B 67/02 | 473/162 |
| 6,062,984 | A * | 5/2000 | Ju | A63B 67/02 | 473/160 |
| 7,147,567 | B2 * | 12/2006 | Yu | A63B 67/02 | 473/190 |
| 9,320,958 | B2 * | 4/2016 | Yoo | A63B 57/00 | |
| 2002/0082100 | A1 * | 6/2002 | Moore | A63B 63/08 | 473/160 |
| 2003/0226393 | A1 * | 12/2003 | Pelz | A63B 57/00 | 73/9 |
| 2004/0152529 | A1 * | 8/2004 | Chen | A63B 67/02 | 473/159 |
| 2009/0124404 | A1 * | 5/2009 | Taira | A63B 69/3676 | 473/157 |
| 2010/0331119 | A1 * | 12/2010 | de la Gandara | A63B 69/3676 | 473/404 |
| 2012/0021845 | A1 * | 1/2012 | Slavik | A63B 67/02 | 473/160 |
| 2012/0295722 | A1 * | 11/2012 | Vancho | A63B 67/02 | 473/157 |
| 2013/0116059 | A1 | 5/2013 | Yeh | | |
| 2013/0231199 | A1 * | 9/2013 | Stockton | A63B 69/3676 | 473/157 |
| 2015/0031465 | A1 * | 1/2015 | McWilliam | A63B 69/3661 | 473/160 |
| 2015/0165286 | A1 * | 6/2015 | Brennan | A63B 57/00 | 473/404 |

FOREIGN PATENT DOCUMENTS

| | | | |
|---|---|---|---|
| KR | 10-2003-0035731 | A | 5/2003 |
| KR | 20-0403089 | Y1 | 12/2005 |
| KR | 20-0467815 | Y1 | 7/2013 |

* cited by examiner

MULTIPURPOSE PUTTING PRACTICE DEVICE FOR ENABLING STRAIGHT PUTTING AND DISTANCE PRACTICE BY SITUATION

CROSS-REFERENCE TO RELATED APPLICATIONS

This application is a continuation application of International Application No. PCT/KR2015/003558 filed on Apr. 9, 2015, which claims benefit of priority from Korean patent application Nos. 10-2014-0045861, 10-2014-0123621, and 10-2015-0046209, filed on Apr. 17, 2014, Sep. 17, 2014, and Apr. 1, 2015, respectively, and the contents of these applications are hereby incorporated by reference in their entirety.

TECHNICAL FIELD

The present invention relates to a multipurpose putting practice device for enabling straight putting and distance practice by situation, and more particularly, to a multipurpose putting practice device for enabling straight putting and distance practice by situation through which a putting practice for a short distance or medium and long distance may be performed in environments having flat, uphill, and downhill lies, a golf ball may be collected at the same place when putting is performed through a putting line formed to protrude in an upward direction, directivity may be improved for running the golf ball up to a target point in a constant direction by determining a hole-out state of the golf ball using sound and visual identification, a correct putting posture is formed, and a distance control practice at a desired field may be performed by quantifying and visualizing the result of the putting so that a plurality of green speeds are compared with each other and experienced.

BACKGROUND ART

Generally, since a golf putting practice is difficult on an ordinary day because golf courses are mainly located at suburbs, putting practice is simply performed indoors or outdoors on the ordinary day through a putting practice device which is separately manufactured.

Such a conventional putting practice device includes a mat, which is similar to green, disposed on a body having a predetermined shape, and a hole formed in the middle of a rear area of the body so that a user performs the putting practice toward the hole at a putting position of a front area of the body.

However, since the conventional putting practice device is formed in a plate shape, there are some problems in which a practice for directivity cannot be performed by putting, a bad habit on a moving direction of a golf ball can occur according to a failure of a levelness state of a mat or bottom surface, and a putting practice for uphill and downhill lies is also difficult, and thus skills used in the practice cannot be demonstrated in an actual field.

In addition, a practice of putting a golf ball toward a hole cup for a medium and long distance is difficult when the putting practice is performed indoors, and there is a problem in which a success rate of putting is very low in the actual field because golf courses each have different lies and speeds of greens.

Further, a practice can be performed using a putting mat in the case of amateurs. However, there is a problem in which golfers having a long experience or professionals are not using a general putting mat.

A putting practice device for enabling a putting practice by integrating lies of actual fields and a plurality of green speeds in consideration of the above problems has been developed by inventors for this present invention.

DISCLOSURE

Technical Problem

The present invention is directed to providing a multipurpose putting practice device, and more particularly, to a multipurpose putting practice device for enabling straight putting and distance practice by situation for improving straight putting sensitivity by visually determining a ball moving in a straight line when putting is performed.

The present invention is also directed to providing a multipurpose putting practice device for enabling straight putting and distance practice by situation through which flat, uphill, and downhill environments are provided in a plurality of field environments having different green speeds and a putting practice may be performed, and a putting practice for a short distance or medium and long distance may be performed.

The present invention is also directed to providing a multipurpose putting practice device for enabling straight putting and distance practice by situation which determines a straightness of a ball moving along a putting line when a putting practice is performed, and simultaneously determines a hole-out of whether the ball has entered into a hole cup or not using sound and visual identification.

The present invention is also directed to providing a multipurpose putting practice device for enabling straight putting and distance practice by situation, through which diverse practices are performable according to distance gradations and a lie display being displayed on the putting practice device, on which a distance gradation display is formed to be used for both amateurs and professionals in field environments having different green speeds.

The present invention is also directed to providing a multipurpose putting practice device for enabling straight putting and distance practice by situation having a hole-out determiner which determines whether a ball has entered into a hole cup or not after putting is performed.

The present invention is also directed to providing a multipurpose putting practice device for enabling straight putting and distance practice by situation that may simply, easily, and correctly adjust a level of the putting practice device.

The present invention is also directed to providing a multipurpose putting practice device for enabling straight putting and distance practice by situation that may freely and easily control a lie by controlling a height of a body to and fro using a lie controller installed in a lower portion of the putting practice device.

The present invention is also directed to providing a multipurpose putting practice device for enabling straight putting and distance practice by situation formed in a clamp type easily detached and attached so that a user arbitrarily adjusts a distance display gradation and a lie, and including a hole-out determiner having a display window through which a distance is checked by visual identification through a gradation after putting is performed.

In addition, the present invention is also directed to providing a multipurpose putting practice device for enabling straight putting and distance practice by situation that provides a vertical departure preventer and a departure preventer, which respectively prevent a departure of a ball from the putting practice device and a departure of a returning ball when a putting practice is performed, on a gradation indicator so that the ball does not depart to the outside even when the ball is hit strongly.

The present invention is also directed to providing a multipurpose putting practice device for enabling straight putting and distance practice by situation through which a golf ball may be collected at the same place when putting is performed through a putting line formed to protrude in an upward direction, directivity is improved so that the golf ball runs up to a target point in a constant direction, and a correct putting posture is formed.

The present invention is also directed to providing a multipurpose putting practice device for enabling straight putting and distance practice by situation through which users may utilize diverse environments, such as desired fields, by quantifying a green speed of each field, and furthermore, by visualizing the speed.

The present invention is also directed to providing a multipurpose putting practice device for enabling straight putting and distance practice by situation through which a user may perform a putting practice without being bored by determining a hole-out using a sound of diverse bells after movable bells that substitutes for a hole cup are installed.

Technical Solution

One aspect of the present invention provides a multipurpose putting practice device for enabling straight putting and distance practice by situation, including a body (102) including a bottom body (10) having a putting line (12) formed to protrude therefrom, sidewalls (14) formed on both sides thereof, a level determiner (106) which controls a lateral level, and a departure preventer (104) provided on a rear end of one side thereof; a connector (200) inserted into and coupled with a front end of the body (102), including a connector putting line (30) formed to be connected to the putting line (12) so that a ball (600) runs in an upward direction, and including connector distance indicators (122 and 124); a vertical body (300) inserted into and coupled with an upper portion of the connector (200), including a vertical body putting line (42) formed to be connected to the connector putting line (30) so that the ball (600) runs in an upward direction, and including vertical body distance indicators (116 and 118); and a hole-out determiner (120) installed in a lateral direction at the connector (200) or the vertical body (300), positioned at the connector putting line (30) or the vertical body putting line (42), and including a hole-out determination bell (62) which determines whether the ball (600) is entered into a hole cup by a sound when the ball (600) is in contact therewith after putting is performed, wherein a putting practice may be performable according to a green speed, a flat level, and a lie.

The level determiner (106) may preferably include a leveler.

The leveler may preferably include a body leveler (15) installed on the body (102) and a vertical body leveler (19) installed on the vertical body (300) to determine a level of the putting line (12) and the vertical body putting line (42).

The level determiner (106) may be preferably provided in a rear portion of the body (102) and installed to control lateral level.

A plurality of lie controllers (108), which are formed to be vertically lifted and adjust a height of the body (102) to control a lie, may be preferably installed under the body (102).

The lie controller (108), in which a male screw portion may be formed that is laterally rotated for a height control so as to adjust a level, provided with a level controller (107) having an insertion groove formed in a lower portion thereof, a protrusion formed to protrude in an upward direction, and a lifting body (22) formed of a lumped mass having a height for implementing a predetermined angle and an insertion groove formed in a lower portion thereof that are formed in plural number and installed to be stackable to each other, may be preferably installed in a lower portion of the body(102).

The lie controller (108) may preferably include a fixed body (20) in which the male screw portion fixed into the lower portion of the body (102) is formed, and a coupler (26) to which the fixed body (20) is screw-coupled.

The vertical body (300) may preferably include a vertical departure preventer (114) having an insertion coupler (50) inserted into and coupled with an upper end of the vertical body (300) so that the ball (600) does not depart in an upward direction and returns after the putting is performed.

The vertical departure preventer (114) may be preferably coupled with a body (40) of the vertical body (300) and may include an insertion coupler (50) coupled with and installed to cover upper portions of the vertical body distance indicators (116 and 118).

The vertical body (300) may include a body (40) of the vertical body (300) formed with a rectangular plate, wherein the vertical body putting line (42) formed to protrude from the center of the body (40) of the vertical body (300) in a long shape may be formed, and both sides of the body (40) of the vertical body (300) may be provided with a vertical body distance indicator (116) on which distance indicating gradations (44) are formed and a vertical body distance indicator (118) on which distance indicating gradations (46) are formed.

An upper departure body (48) which connects the vertical body distance indicator (116) and the vertical body distance indicator (118) may be preferably provided on an upper portion of the body (40) of the vertical body (300), and may be formed to protrude in a forward direction.

An impact preventer (74) formed of a soft material may be preferably provided inside the upper departure partition (48) to absorb an impact of the ball (600) which excessively runs over a target distance and to prevent a departure of the ball (600) to the outside when putting is performed.

Lie indicators (66) by green speeds (ft), which may be used for both amateurs and professionals in field environments having different green speeds, may be formed on the vertical body distance indicators (116 and 118) and the connector distance indicators (122 and 124).

The lie indicators (66) by green speeds (ft) may display flat distance gradations (70), and downhill distance gradations (68) and uphill distance gradations (72) by angles.

The distance indicating gradations (44) may preferably display target distance gradations by meters (m), distance gradations by feet (ft), and target distance gradations by uphill and downhill lies for amateurs, and the distance indicating gradation (46) may preferably display target distance gradations by meters (m), distance gradations by feet (ft), and target distance gradations by uphill and downhill lies for professionals.

The hole-out determiner (120) may include a clamp (121) inserted into and coupled with a body (40) of the vertical body (300) and a connector body (28) and including a gradation determination window (56) which determines a distance, a holder (58) which extends from one side end of the damper (121) and is formed to be bent, and a rotatable hinge part (123) through which the hole-out determination bell (62) is connected to a center portion of the holder (58) to be rotatable.

The clamp (121) may preferably include the gradation determination window (56) which determines and compares downhill, flat, uphill distances by green speeds of the vertical body distance indicators (116 and 118) and the connector distance indicators (122 and 124).

The clamp (121) may be preferably formed with a rectangular clamp body (52) and a gradation determination body (54), wherein the gradation determination window (56) may be formed on one side surface of each of the clamp body (52) and the gradation determination body (54) to display distance indicating gradations (44 and 46) formed on inner and outer side surfaces of the vertical body distance indicators (116 and 118) and distance indicating gradations (76 and 78) formed on inner and outer side surfaces of the connector distance indicators (122 and 124).

The rotatable hinge part (123) may be preferably formed with a position holder (64) formed in the center portion of the holder (58), and a fixed protrusion (60) of the hole-out determination bell (62), and the hole-out determination bell (62) may make a sound and rotates about the position holder (64).

Advantageous Effects

The present invention has effects in which putting skills of professionals in addition to amateurs can be improved by correcting a posture to run a ball straightly when a putting practice is performed on a flat lie, and confidence in a sense of distance can be obtained because different distances can be immediately compared and determined when the putting practice is repeatedly performed using the same width of swing and the same power control in flat, uphill, and downhill environments of fields having different green speeds, thereby a sense of situational putting distance can be experienced.

Further, the present invention has excellent effects in which an accuracy of putting can be clearly understood because whether a ball is entered into a hole cup or not can be conveniently determined, a level of a putting mat can be easily and correctly adjusted, and the ball can be managed so that the ball does not depart to the outside.

MODES OF THE INVENTION

Figure 1:
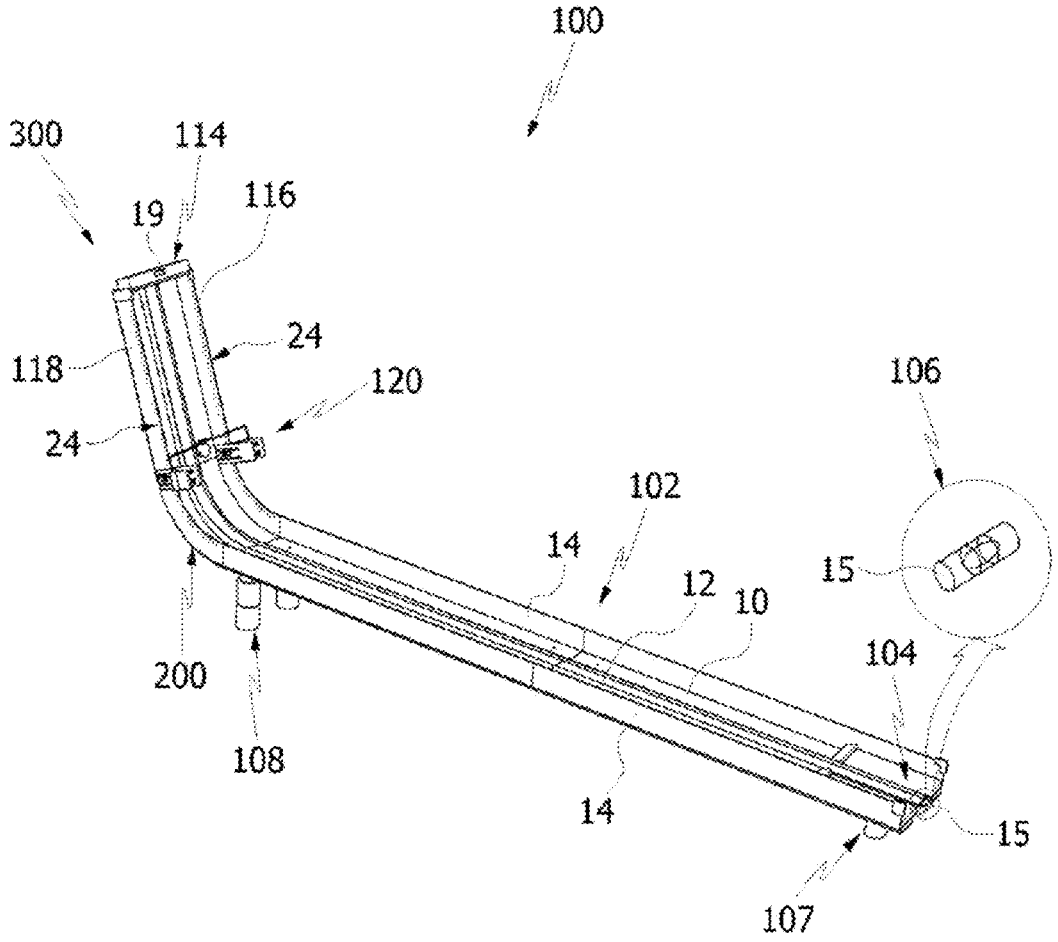
FIG. 1 is a perspective view illustrating a structure of a multipurpose putting practice device for enabling straight putting and distance practice by situation according to an embodiment of the present invention.
Figure 2:
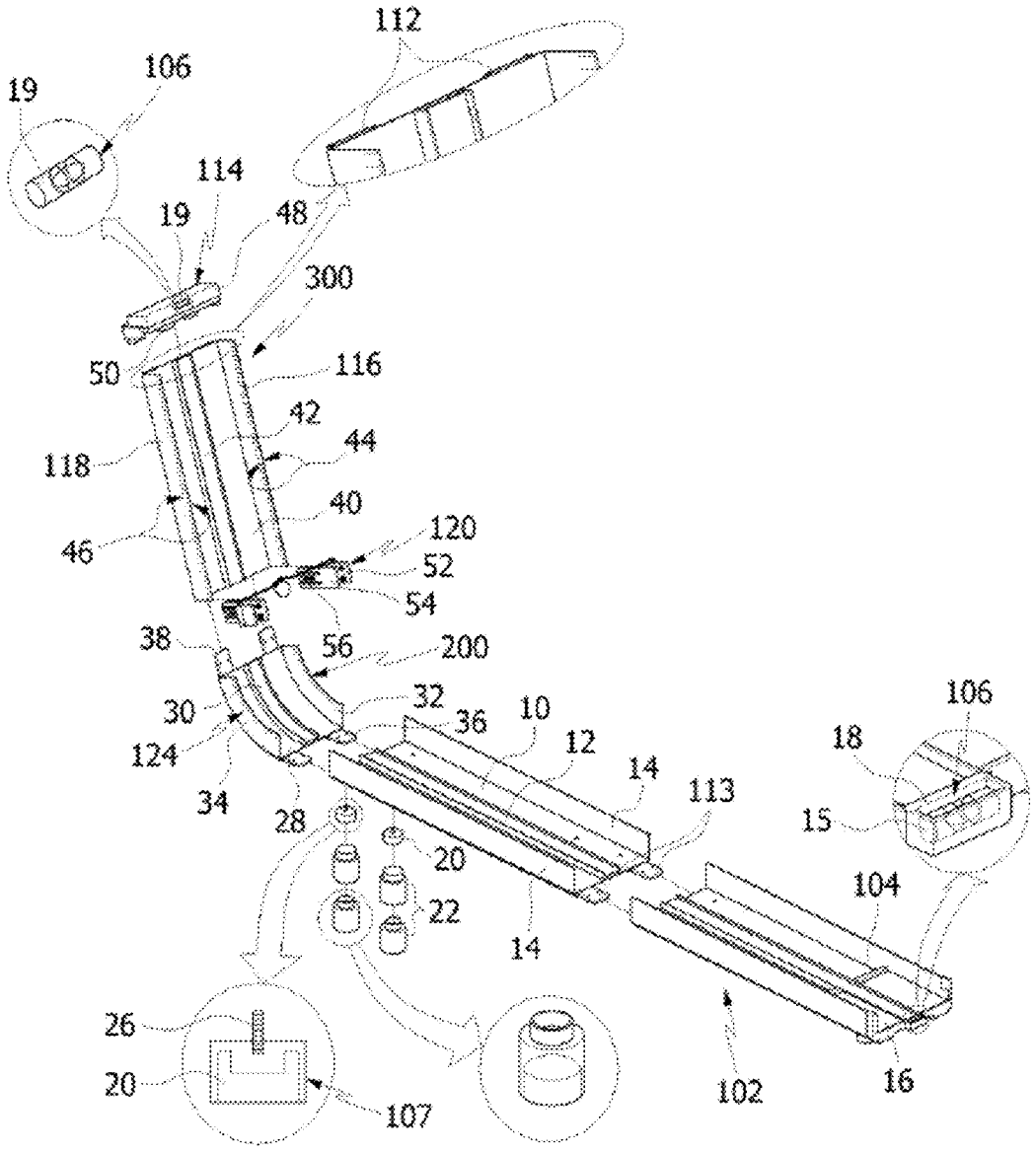
FIG. 2 is an exploded perspective view illustrating the structure of the multipurpose putting practice device for enabling the straight putting and distance practice by situation according to the embodiment of the present invention.
Figure 3:
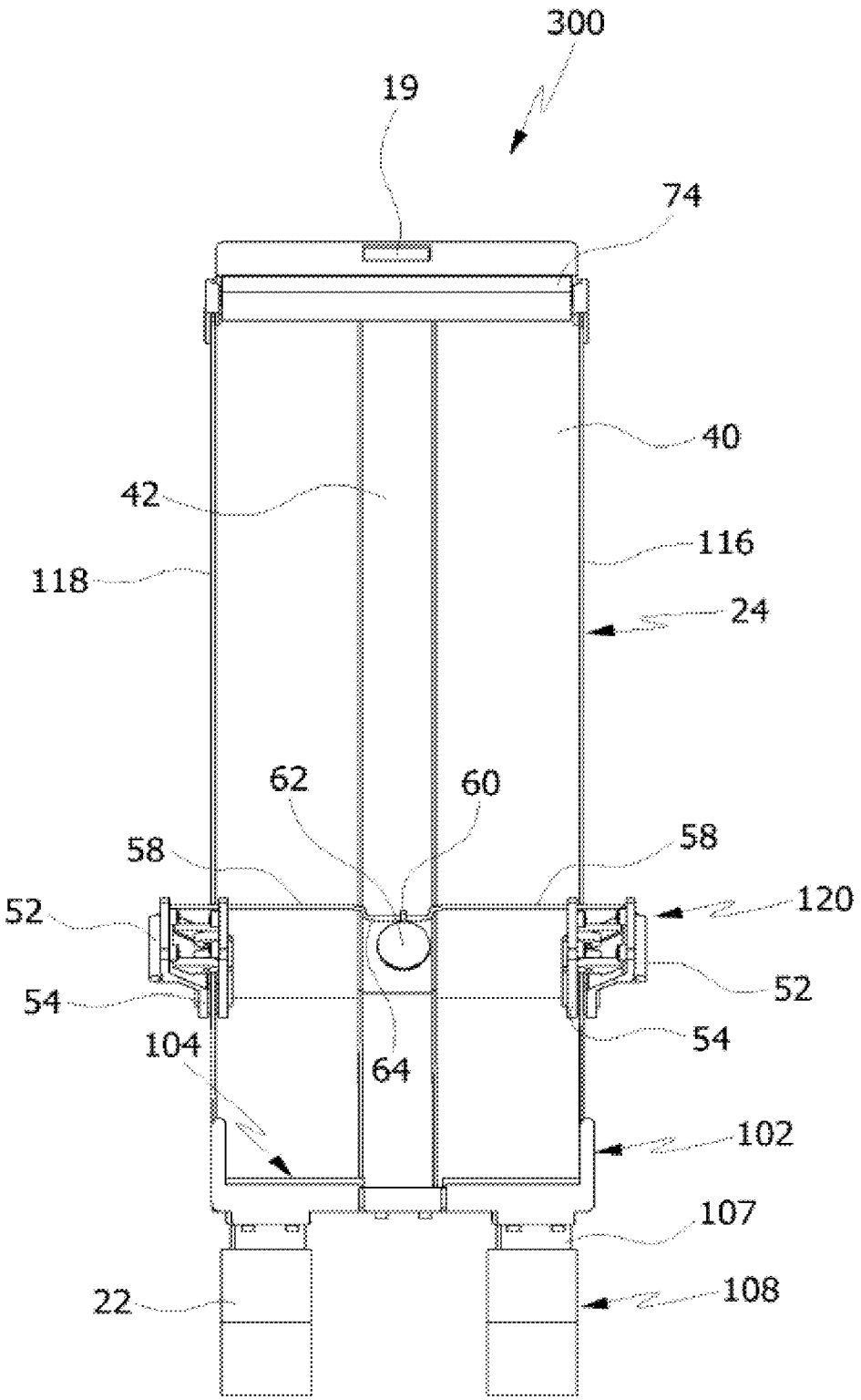
FIG. 3 is a side view illustrating the structure of the multipurpose putting practice device for enabling the straight putting and distance practice by situation according to the embodiment of the present invention.

A multipurpose putting practice device 100 for enabling straight putting and distance practice by situation according to an embodiment of the present invention will be described with reference to FIGS. 1 to 11. First, as shown in FIGS. 1 to 3, in the embodiment of the present invention, a body 102 for putting a ball, which has been placed on a bottom surface thereof, in a longitudinal direction is formed.

The body 102 may be formed with two or more bodies that may be coupled to each other. A departure preventer 104 is installed on an upper surface of a rear portion of the body 102 so that a ball 600 does not depart.

A level determiner 106 is preferably installed in a rear portion of the departure preventer 104 for adjusting a level of the body 102.

The level determiner 106 is a general leveler 15, and is preferably installed to be accommodated in a receiving groove 18.

Further, a vertical body leveler 19 is preferably installed for a level determination of a vertical body putting line 42 to be described below.

Level controllers 107 are preferably installed under the bottom surface of the body 102, and a plurality of lie controllers 108 are installed thereunder.

The level controllers 107 are respectively and preferably installed in upper portions of the lie controllers 108 and fixedly coupled with the body 102.

Two level controllers 107 are preferably installed under each of a front portion and a rear portion of the bottom surface of the body 102. In each of the level controllers 107, a male screw portion is formed so that a level is adjusted by laterally rotating to control a height, and an insertion groove is formed in a lower portion thereof.

The lie controllers 108 preferably control lies of the front and rear of the bottom surface of the body 102 by lifting the body 102 after lifting bodies 22 are inserted into and coupled with lower portions of the level controllers 107 under the bottom of the body 102. That is, it is preferable that a lie control of the body 102 be performable by lifting the front of the body 102 or lifting the rear of the body 102.

Here, the lifting body 22 is provided with a plurality of lumped masses having a predetermined height for implementing a lie angle of the body 102 which are stackable.

In addition, a connector 200 is preferably and connectedly installed on the body 102 in a forward direction, and more preferably, on a front end of the body 102 in a moving direction of the ball 600 after putting is performed.

The connector 200 is inserted into, coupled with, and installed on a lower end portion of the body 102.

Here, the connector 200 is formed with a connector body 28 that has a circular arc shape in cross section, a gentle lie, and an upper end that is inserted into, coupled to, and installed on a vertical body 300 to be described below.

Since the vertical body 300 is inserted into, coupled with, and installed on the upper end of the connector 200, the vertical body 300 prevents an excessive departure of the ball 600 in an upward direction after putting is performed, and is preferable so that a putting practice may be performed according to a distance desired by a user after a determination of a distance measured when the putting practice is performed. That is, it is preferable to form distance indication gradations 44 and 46 so that putting practices for flat, uphill, and downhill lies are performable based on a green speed.

A vertical departure preventer 114 is provided in a center portion of the vertical body 300, and is preferably coupled to the vertical body 300 as an integrated part.

A soft impact preventer 74 is inserted into the vertical departure preventer 114 to prevent excessive departure of the ball 600 in the upward direction when a putting practice is performed.

At the same time, vertical body distance indicators 116 and 118, which are formed so that a practice may be performed according to a distance and a lie that are desired for the practice when putting is performed are respectively installed on lateral side surfaces of the vertical body 300. That is, the vertical body distance indicator 116 is formed on a right side surface of the vertical body 300, and the vertical body distance indicator 118 is formed on a left side surface thereof.

Here, the vertical body distance indicators 116 and 118 preferably display putting distance indications for flat, uphill, and downhill lies based on a green speed so that skills of professionals in addition to general users may be improved by a practice.

In addition, a hole-out determiner 120 having a hole-out determination bell 62 is preferably installed above the vertical body 300 and the connector 200.

The hole-out determiner 120 is installed so that the ball 600 hits and passes through the hole-out determination bell 62 and makes a sound or is visually identified after putting is performed.

Further, the hole-out determiner 120 may include a gradation determination window 56 which may determine distances of the vertical body distance indicators 116 and 118 and connector distance indicators 122 and 124.

Artificial turf or a carpet mat is preferably attached and installed on one side of the body 102, the connector 200, and the vertical body 300, which are described above.

Subsequently, the multipurpose putting practice device 100 for enabling straight putting and distance practice by situation according to the embodiment of the present invention will be described in more detail. First, a bottom body 10 is formed extending along the bottom surface of the body 102 to be long, and a putting line 12, which extends in a longitudinal direction to be long and has a predetermined width so that the ball 600 runs on a straight line, protrudes from and is formed in the center portion of the bottom body 10.

Since the putting line 12 protrudes in an upward direction more than the bottom body 10, when the ball 600 runs out of a straight line after putting is performed, the ball 600 runs to a left or right side of the putting line 12.

Sidewalls 14 are respectively formed on both lateral sides of the bottom body 10.

When the ball 600 runs out of the putting line 12, the sidewalls 14 serve to prevent a departure of the ball 600 to the outside of the bottom body 10.

Using the putting line 12, a golf ball may run to a target point in a constant direction when a putting practice is performed, and thus a putting ability can be improved.

Since the departure preventer 104 is installed in a rear portion of the bottom body 10 of the body 102 to prevent a departure of the ball 600 to the rear portion of the bottom body 10 when the ball 600 runs and returns, the departure preventer 104 is formed with two rectangular departure preventer bodies 16, and the entire departure preventer bodies 16 are obliquely formed.

When a height of the departure preventer 104 is slightly greater than that of the putting line 12, it serves to prevent a departure of the ball 600 which returns through the connector 200 after putting is performed and to easily place the ball 600 on the putting line 12.

In addition, a body leveler 15 for adjusting a level of the putting line 12 of the body 102 is preferably installed in the rear portion of the departure preventer 104.

That is, the body leveler 15 installed on the body 102 and the vertical body leveler 19 to be described below serve to adjust the level of the putting line 12, a connector putting line 30, and the vertical body putting line 42.

Meanwhile, since the plurality of lie controllers 108 are installed on a lower surface of the body 102 for achieving a match of a lie with a green lie by a lifting control of each of the front and rear portions of the body 102, the lie controllers 108 and level controllers 107 fixedly installed under the bottom surface of the body 102 are provided in insertion grooves having cylindrical shapes with a plurality of lumped masses, which are stackable, having a predetermined height for implementing a lie angle of the body 102.

The level controller 107 is formed with a fixed body 20 formed in a cylindrical shape and having a bolt portion in an upward direction, and a lifting body 22 coupled with a lower portion of the fixed body 20 and formed so that a vertically height control may be performed.

When a lie is formed right downward by lifting the front portion of the body 102 by coupling the lifting bodies 22 to lower portions of the level controllers 107, the lie controllers 108 installed under the front portion of the body 102 installed as described above make an uphill lie needed for putting. When the lie is formed left downward by lifting the rear portion of the body 102 by coupling the lifting bodies 22 to the fixed bodies 20, the lie controllers 108 under the rear portion of the body 102 make a downhill lie.

Fronts and rears of the lifting bodies 22 are coupled with or separated from the level controllers 107 or the fixed bodies 20, and thus a height is freely controlled and lies of the front and rear of the body 102 are controlled. Thereby, the lie controllers 108 make a lie similar to a green lie.

As described above, the lie controllers 108 are preferably installed so as to control a height of the body 102 to take the same effect as that generated by a practice performed on an uphill or downhill lie of an actual field.

The multipurpose putting practice device 100 for enabling the straight putting and distance practice by situation according to the embodiment of the present invention installed as described above, as shown in FIGS. 2 and 3, is installed so that the body 102, connector 200, and vertical body 300 are connected to each other. Here, the connector 200 may include the connector putting line 30 connected to the putting line 12 of the body 102, and the vertical body 300 may include the vertical body putting line 42 connected to the connector putting line 30.

The hole-out determiner 120 is installed and located at the center portion of the vertical body putting line 42 of the vertical body 300 connected to the connector putting line 30 of the connector 200.

That is, when the ball 600 runs along the putting line 12 and reaches the connector putting line 30 or the vertical body putting line 42 while the putting practice is performed, the hole-out determination bell 62 is preferable installed to generate a sound when the ball hits it.

Figure 4:
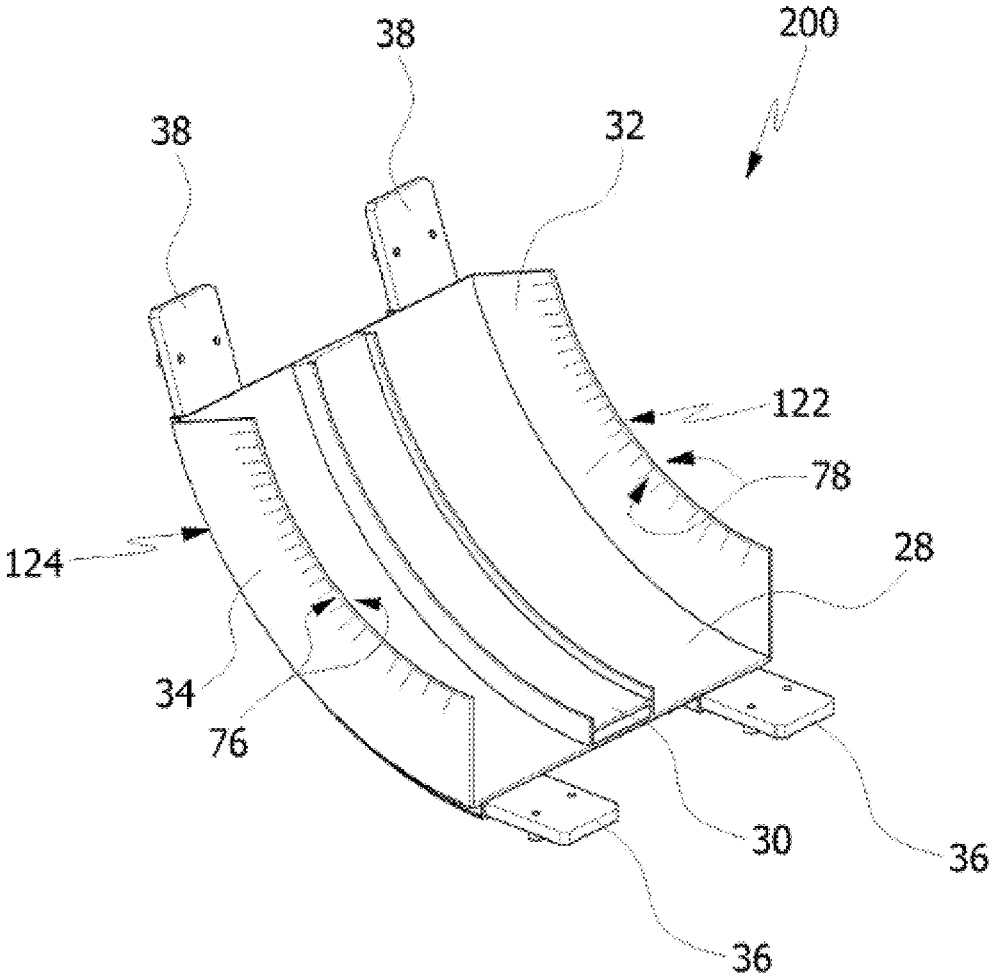
FIG. 4 is a perspective view illustrating a structure of a connector of the multipurpose putting practice device for enabling the straight putting and distance practice by situation according to the embodiment of the present invention.

FIG. 4 is a perspective view illustrating a structure of the connector of the embodiment of the present invention. The connector 200 is formed with a connector body 28 having a side cross section in a circular arc shape, and a connector putting line 30 is formed to protrude in an upward direction in a center portion of the connector body 28.

The connector putting line 30 is preferably formed to connect with the putting line 12 of the body 102.

Subsequently, connector sidewalls 32 and 34 are respectively formed on lateral sides of the connector body 28.

Connector distance indicators 122 and 124 are respectively formed on the connector sidewalls 32 and 34, and connector distance indicating gradations 76 and 78 may be respectively formed on inner and outer surfaces of the connector body 28.

A lower insertion portion 36 is formed in the center lower portion of the connector body 28.

The lower insertion portion 36 is inserted into, coupled with, and installed in the rear portion of the body 102, on which the ball 600 runs, and is preferably coupled therewith and installed therein so that the connector putting line 30 is aligned with the putting line 12.

In addition, an upper insertion portion 38 is formed in the center upper portion of the connector body 28.

The upper insertion portion 38 is preferably inserted into and installed in a lower end portion of the vertical body 300 to be aligned with the vertical body putting line 42 of the vertical body 300.

Figure 5:
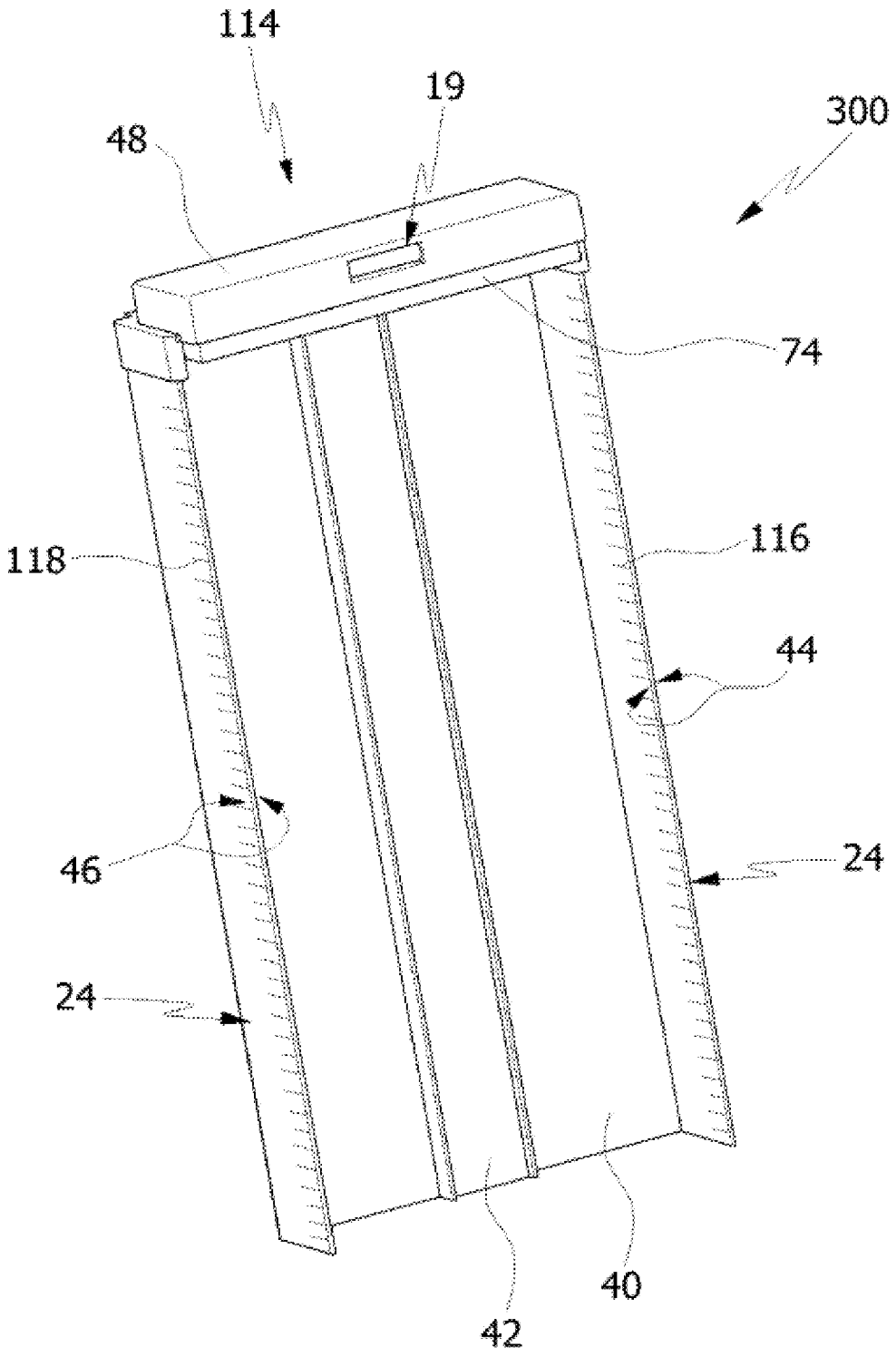
FIG. 5 is a perspective view illustrating a structure of a vertical body of the multipurpose putting practice device for enabling the straight putting and distance practice by situation according to the embodiment of the present invention.

FIG. 5 is a perspective view illustrating a structure of the vertical body according to the embodiment of the present invention, and the body 102 and the connector 200 are connected in an upward direction. The vertical body 300 is formed with a rectangular body 40, a vertical body putting line 42 is formed to protrude from the center portion thereof, a vertical departure preventer 114 is formed in an upper portion of the vertical body putting line 42, and vertical body distance indicators 116 and 118 are respectively formed on lateral sides of the body 40 of the vertical body 300.

Distance indicating gradations 44 and 46 are respectively formed on inner and outer side surfaces of each of the vertical body distance indicators 116 and 118.

That is, lie indicators 66 by green speeds (ft), which may be used for both amateurs and professionals in field environments having different green speeds, are formed on the vertical body distance indicators 116 and 118.

Here, vertical body distance indicating gradations 44 and 46 and connector distance indicating gradations 76 and 78 are displayed on the lie indicator 66 by green speeds (ft), and a type having a flat distance gradation 70, and a downhill distance gradation 68 and an uphill distance gradation 72 by a predetermined angle unit may also be displayed thereon.

The vertical departure preventer 114 is coupled with and installed on an upper end side of the body 40 of the vertical body 300 so that the ball 600 does not depart. The vertical departure preventer 114 is formed as an integrated part, and an upper departure partition 48 coupled in a downward direction from an upper end of the vertical body 300 is formed in a lateral direction.

An insertion coupler 50 is formed in a lower portion of the upper departure partition 48 to insert into the vertical body 300.

A departure of the ball 600 from the vertical body 300 is preferably prevented by forming the upper departure partition 48 protruding in a forward direction of the vertical body 300 so that the ball 600 does not depart in an upward direction. That is, the vertical body 300 is formed to have slope having a predetermined departure preventing angle A, and the departure preventing angle A is preferable in a range of 100 degree to 130 degree. When the ball runs upwardly along a putting line, the ball hits a soft impact preventer 26 which absorbs an impact, and then the ball returns downwardly so that the departure of the ball is prevented.

Meanwhile, the connector distance indicator 122 and 124 and the vertical body distance indicators 116 and 118, which are quantified and visualized green speeds, may be displayed as green speeds by courses (4.5 ft to 10.5 ft) that are the announced green speeds of golf courses measured by Stimpmeter, which is a formal green speed gauge of United States Golf Association (USGA).

Like this, Stimpmeter, the green speed gauge, is used to measure green speeds by courses on green turf, artificial turf, or a carpet mat for measuring the green speeds. That is, when Stimpmeter, i.e., the gauge, is installed on the green turf, the artificial turf, or the carpet mat on which the green speeds by courses are measured, and the gauge for measuring gradation and supporting the golf ball at a height of specific location is lifted upward, the ball 600 freely falls along a lie and then a run distance by a meter (M) unit may be measured. After the measured value is separately recorded for each of the green speeds by courses, measurements are performed several times at a height at which the measured value is recorded using the multipurpose putting practice device 100 for enabling the straight putting and distance practice by situation. Then, distances by different green speeds (ft) according to a flat level and lies are classified for amateurs and professional, and may be displayed on the connector distance indicators 122 and 124 and the vertical body distance indicators 116 and 118 in various types such as stickers, prints, etc.

Like this, a sensitivity of existing green speeds is experienced through the displayed connector distance indicators 122 and 124, the vertical body distance indicators 116 and 118, and the hole-out determiner 120, and putting practices are performed with a determination of green states according to the lies and distances, and thus professionals in addition to amateurs can practice usefully.

Figure 6:
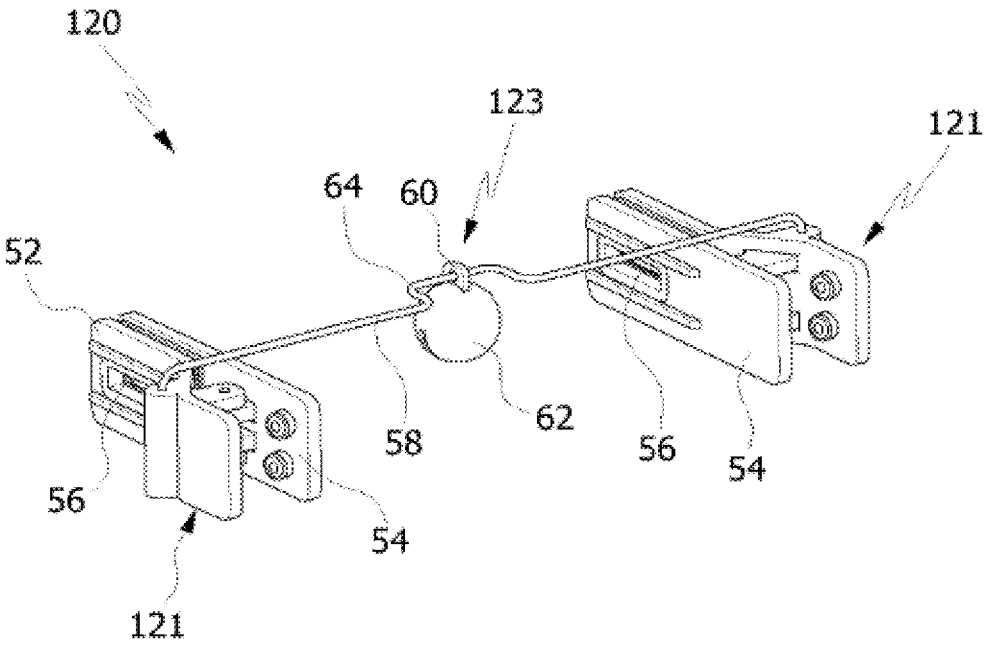
FIG. 6 is a perspective view illustrating a structure of a hole-out determiner of the multipurpose putting practice device for enabling the straight putting and distance practice by situation according to the embodiment of the present invention.

Since the hole-out determiner 120 is for determining whether the ball 600 is entered into a hole cup or not when a putting practice is performed, as shown in FIG. 6, clamps 121 are symmetrically formed in both directions to be fixedly inserted into the connector distance indicators 122 and 124 and the vertical body distance indicators 116 and 118 of the body 40 of the vertical body 300.

Gradation determination windows 56 are respectively formed in the clamps 121 so that the distance indicating gradations 76, 78, 44, and 46 of the connector distance indicators 122 and 124 and the vertical body distance indicators 116 and 118 are displayed.

In more detail, the clamp 121 includes a rectangular clamp body 52 and a gradation determination body 54, and the gradation determination windows 56 are formed on one side surfaces of the clamp body 52 and the gradation determination body 54, and preferably, formed to display the distance indicating gradations 44 and 46 of the vertical body distance indicators 116 and 118.

A rotatable hinge part 123 is preferably provided to the clamp 121.

The rotatable hinge part 123 is formed with a rotatable fixed protrusion 64 and a fixed protrusion 60 rotatably inserted into the rotatable fixed protrusion 64.

The distance indicating gradations 44, 46, 76, and 78 are preferably determined through the gradation determination windows 56.

A holder 58, which extends and is bent in a ┐-shape, is connectedly installed above the clamp body 52, and the rotatable fixed protrusion 64 is formed in a center portion of the holder 58.

The rotatable fixed protrusion 64 is formed in a ⊏-shape, and is preferably coupled with and installed on the hole-out determination bell 62 to be rotatable.

Since the hole-out determination bell 62 is installed on the rotatable fixed protrusion 64 to be rotatable, the fixed protrusion 60 is formed in an upper portion of the hole-out determination bell 62 and coupled to the rotatable fixed protrusion 64 formed on an end of the holder 58, and the fixed protrusion 60 is rotatable based on the holder 58. That is, since the fixed protrusion 60 of the hole-out determination bell 62 is coupled and installed, when the ball 600 runs and touches the hole-out determination bell 62 after putting is performed, the hole-out determination bell 62 makes a sound and rotates about the rotatable fixed protrusion 64 of the holder 58.

Figure 8A:
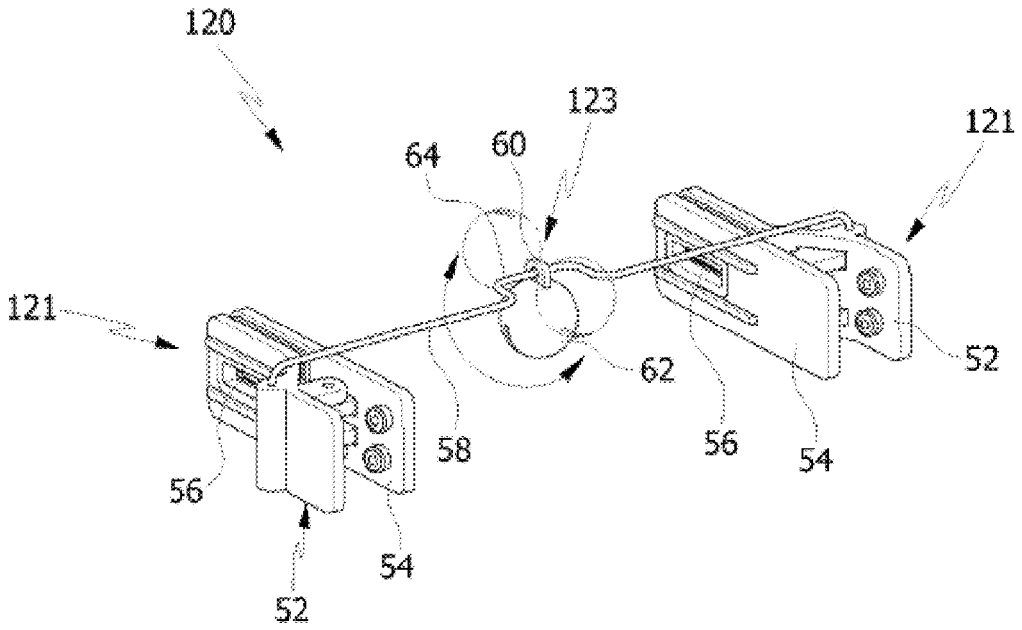
FIGS. 8A and 8B are perspective views illustrating a use state of the hole-out determiner of the multipurpose putting practice device according to the embodiment of the present invention.
Figure 8B:
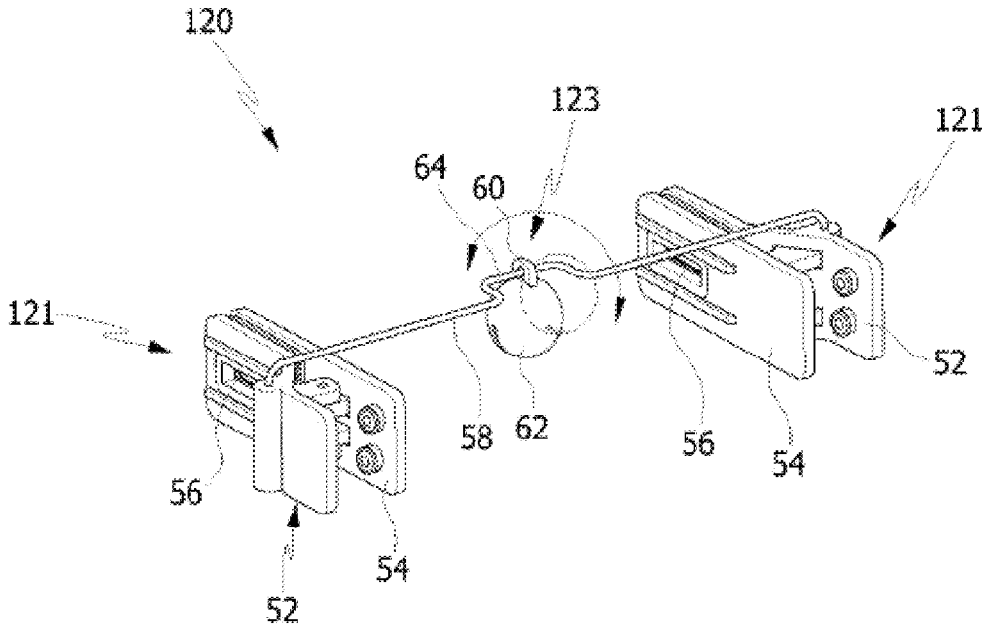

Here, as shown in FIGS. 8A and 8B, when the hole-out determination bell 62 rotates at a constant rotation angle a, the ball 600 does not pass through and is entered into a hole cup, and when the hole-out determination bell 62 rotates at a predetermined rotation angle b or more, or fully rotates a full rotation or more, the ball 600 passes through the hole cup and may be determined as not hole-out.

Figure 7A:
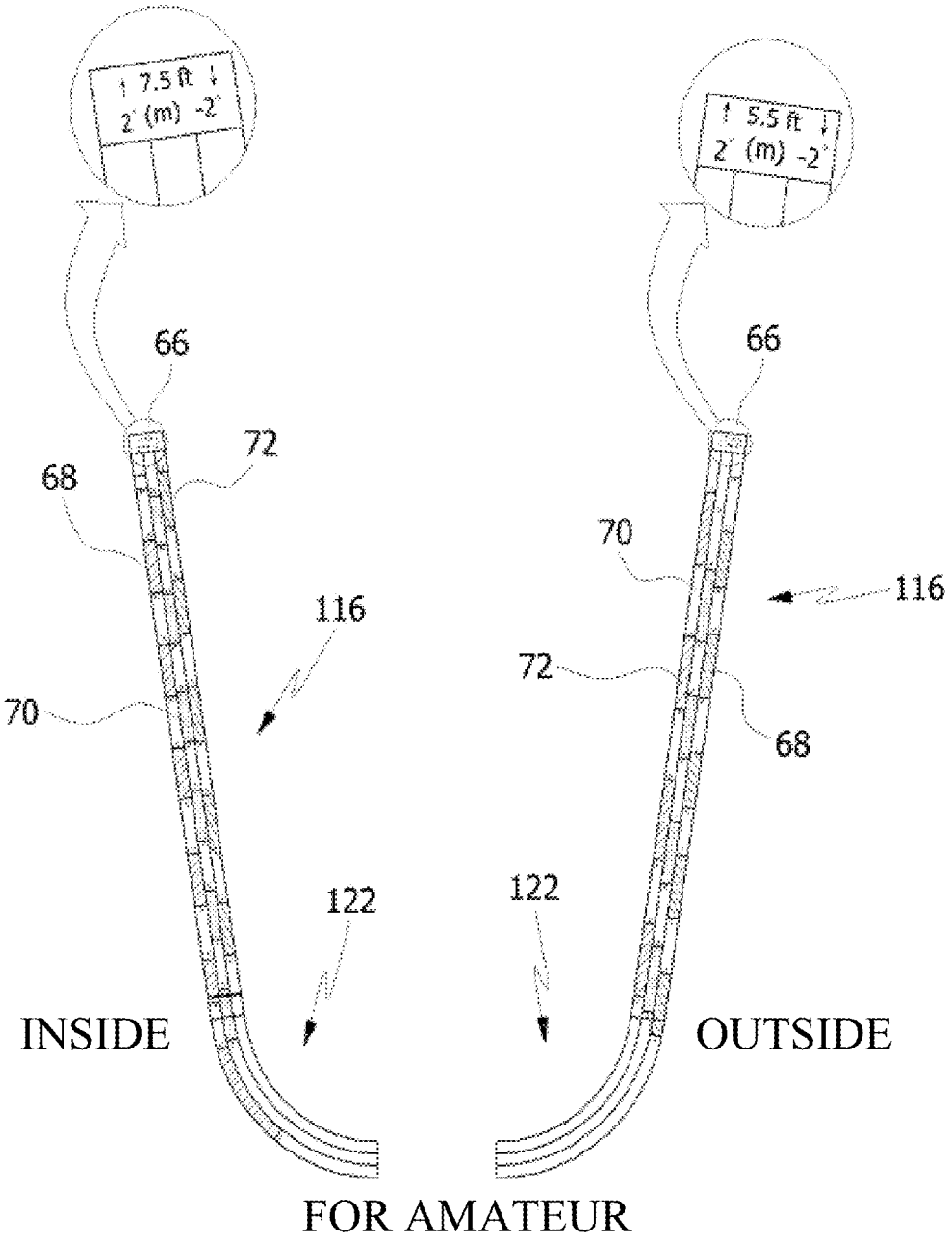
FIGS. 7A and 7B are views illustrating distance indicators of the multipurpose putting practice device for enabling the straight putting and distance practice by situation according to the embodiment of the present invention.
Figure 7B:
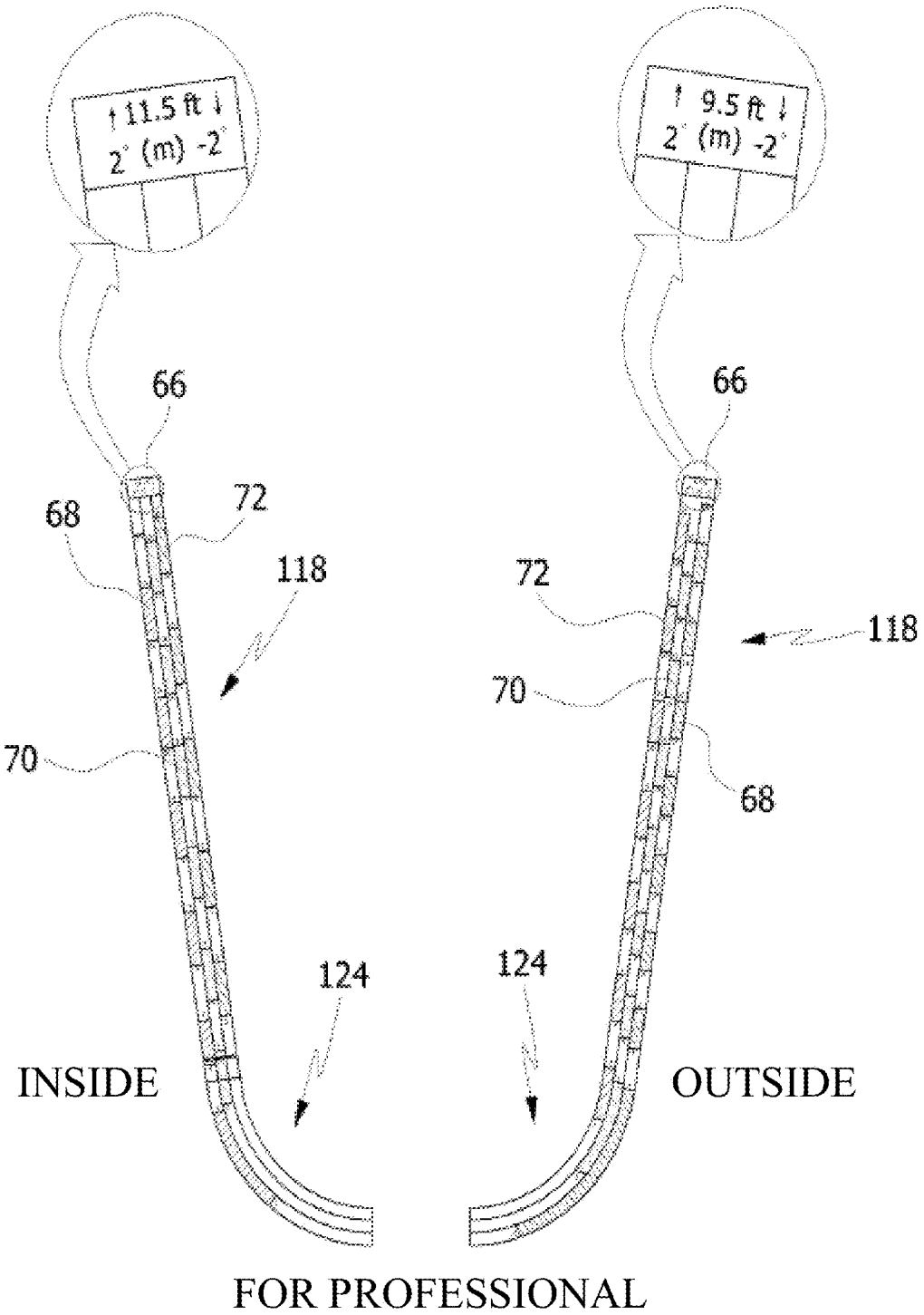

Subsequently, FIGS. 7A and 7B are views illustrating the distance indicating gradations 44, 46, 76 and 78 of the connector distance indicators 122 and 124 and the vertical body distance indicators 116 and 118 according to the embodiment of the present invention, and lie indicators 66 by green speeds (ft) are respectively formed on left and right side surfaces of the vertical body distance indicator 116 and 118, i.e., outer and inner surfaces thereof.

In more detail, the distance indicating gradations 44, 46, 76, and 78 of the lie indicators 66 by green speeds (ft) are displayed as flat distance gradations 70, and downhill distance gradations 68 and uphill distance gradations 72 by predetermined angles.

The lie indicator 66 by green speeds (ft) may be implemented and displayed as various shapes for gradation indication to provide target distances of amateurs and professionals.

Figure 9A:
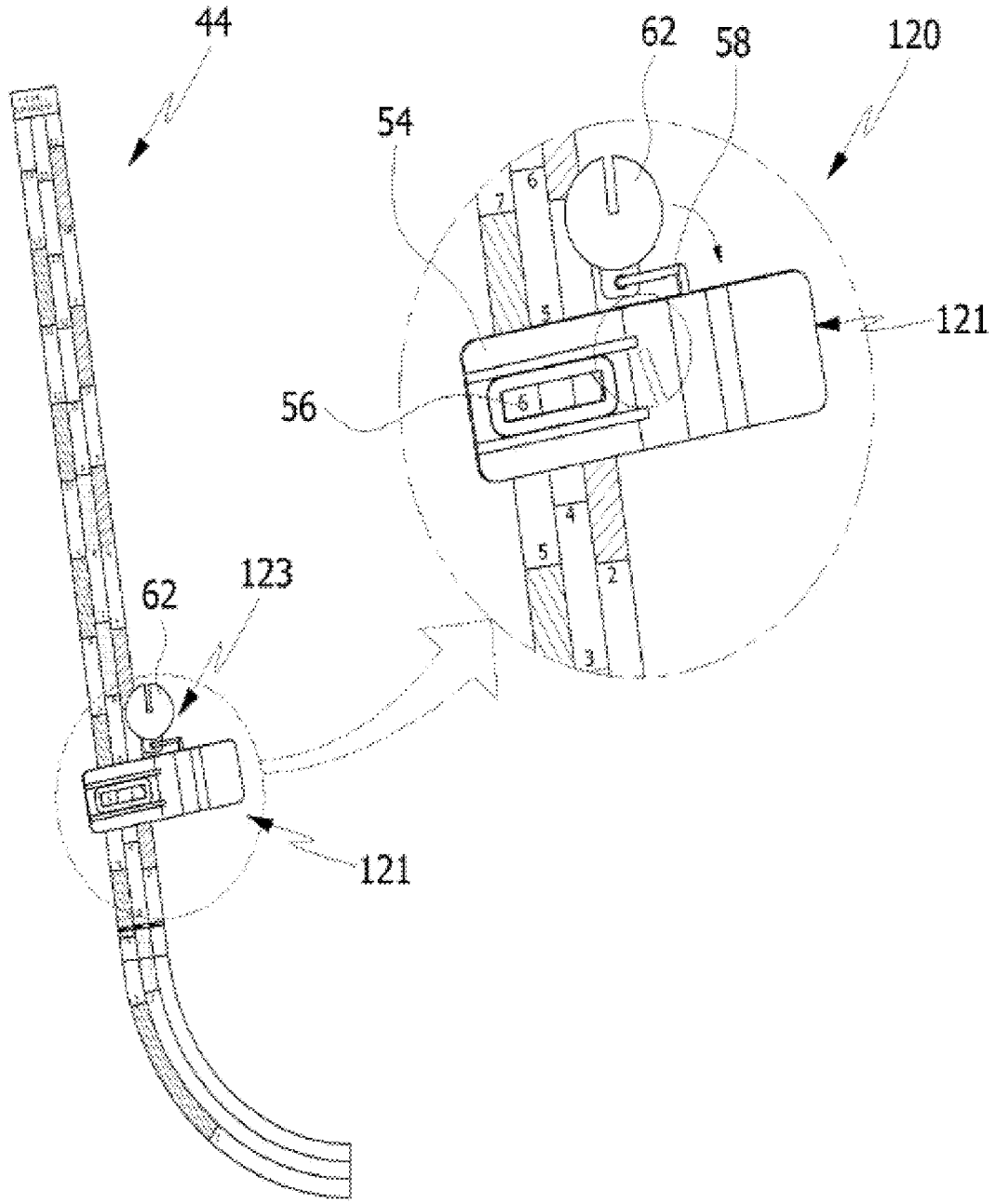
FIGS. 9A, 9B, and 9C are views illustrating one example of a distance indication of the multipurpose putting practice device for enabling the straight putting and distance practice by situation according to the embodiment of the present invention.
Figure 9B:
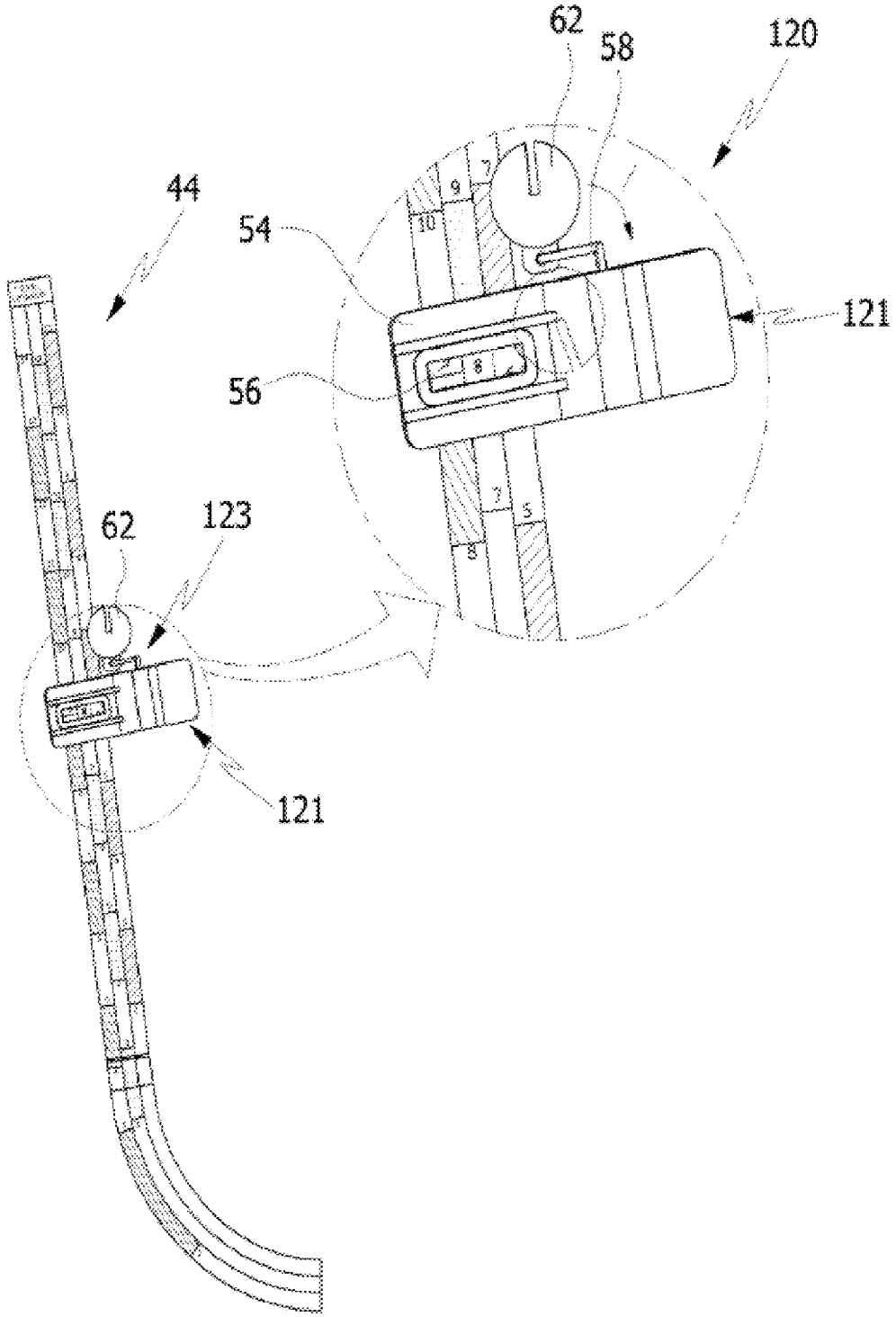
Figure 9C:
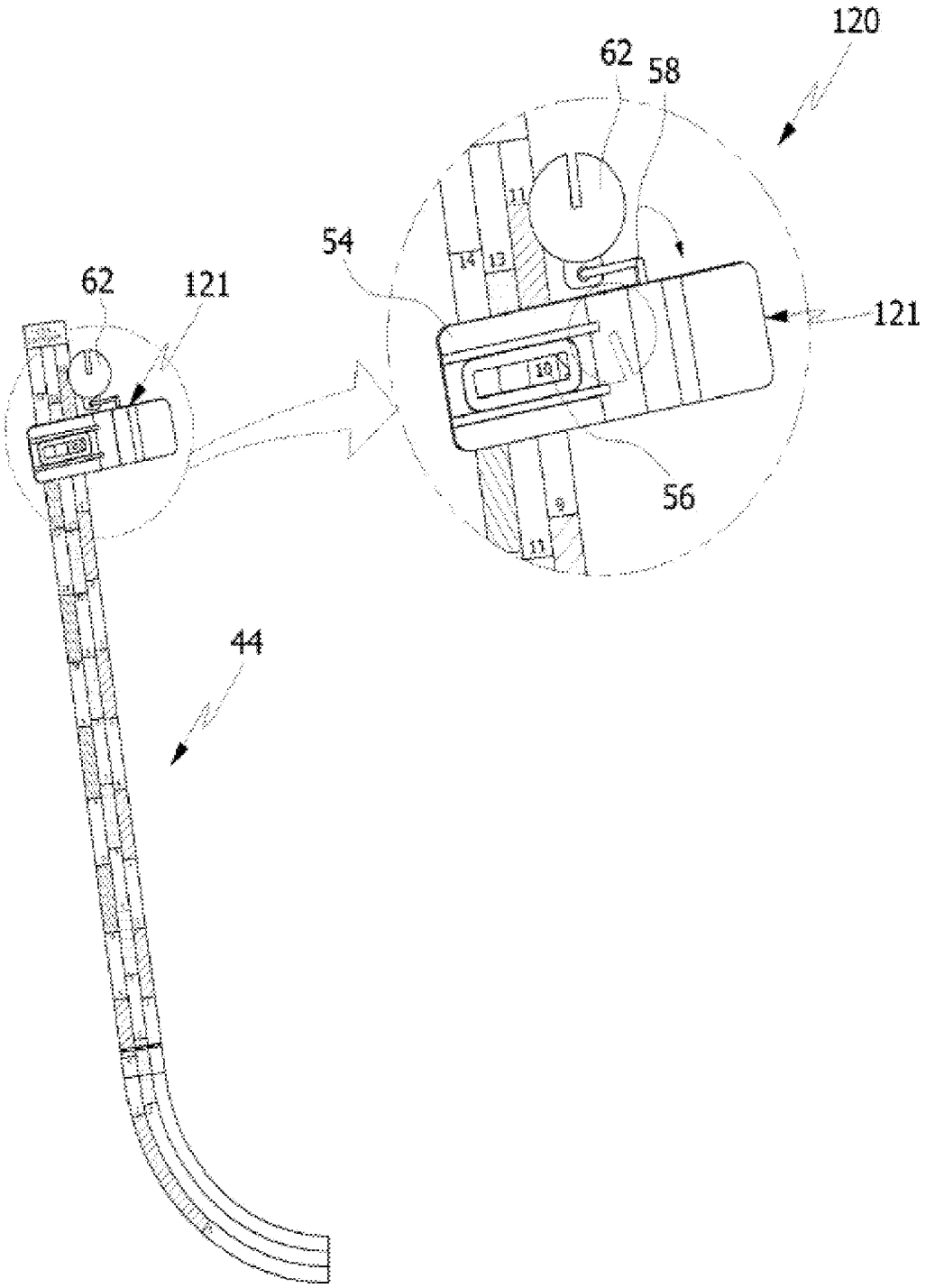

FIGS. 8A and 8B are perspective views illustrating a use state of the hole-out determiner 120 of the multipurpose putting practice device 100 according to the embodiment of the present invention, and FIGS. 9A to 9C are views illustrating use states according to connector distance indicators 122 and 124 and vertical body distance indicator 116 and 118 according to the embodiment of the present invention.

As shown in FIGS. 8A and 8B, when the hole-out determination bell 62 of the hole-out determiner 120 rotates within a predetermined rotation angle a with a small sound, this means that the ball 20 does not pass through and is entered into the hole cup.

In addition, when the hole-out determination bell 62 rotates at a predetermined rotation angle b or rotates a full rotation and makes a big sound, this means that the ball 20 passes through and is not entered into the hole cup because a putting force was strong when putting was performed.

As shown in FIGS. 9A to 9C, amateurs and professionals may determine distances needed for themselves, and may perform a putting practice after setting to display the distance through the gradation determination windows 56 of the hole-out determiner 120.

Figure 10A:
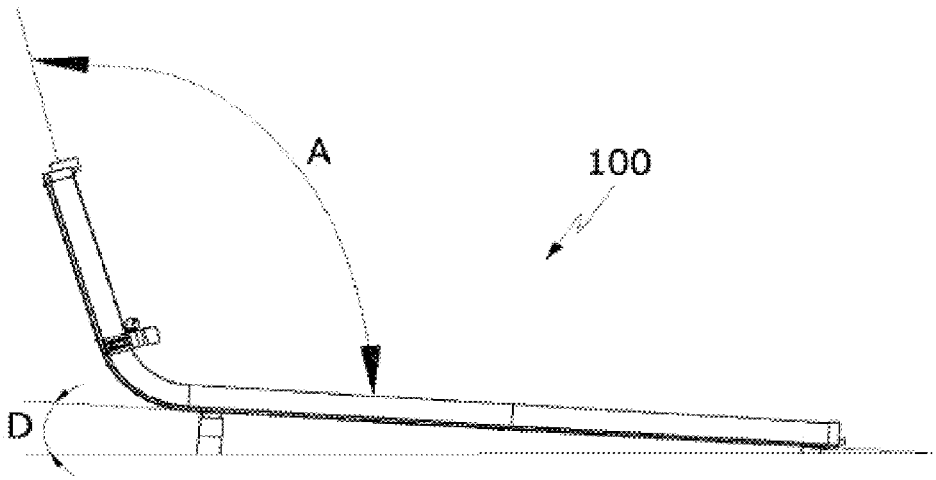
FIGS. 10A and 10B are views illustrating uphill and downhill lies of the multipurpose putting practice device for enabling the straight putting and distance practice by situation according to the embodiment of the present invention.
Figure 10B:
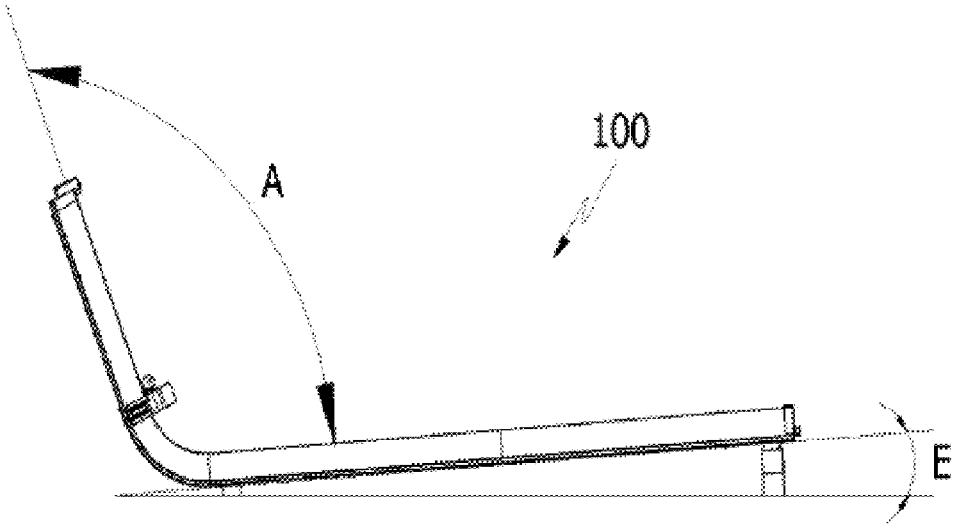

In addition, FIGS. 10A and 10B are views illustrating states in which lies D and E are adjusted to enable a putting practice by controlling a lie of the multipurpose putting practice device 100 for enabling the straight putting and distance practice by situation according to the embodiment of the present invention.

The lie controller 108 installed under the body 102 is coupled with a front side portion of the body 102, an uphill lie D is adjusted at a specific angle, e.g., a range of 2 to 4 degrees, and then a putting practice may be performed.

In addition, the lie controller 108 installed under the body 102 is coupled with a rear side portion of the body 102, a downhill lie E is adjusted at a specific angle, e.g., a range of 2 to 4 degrees, and then a putting practice may be performed.

Like this, by using the embodiment of the present invention, a putting practice on a straight line is possible using the putting line 12 formed to protrude from the center of the bottom body 10 of the body 102, a lie may be controlled through the lie controller 108, a putting practice for a short distance or medium and long distance may be performed in flat, uphill, and downhill environments, and a lie corresponding to an actual field may be experienced.

Further, by using the embodiment of the present invention, a golf ball runs up to a target point in a constant direction through the putting line 12 protruding from the center of the body 102 to be long, and thus directivity is improved when putting is performed, a distance control practice may be performed in a desired field by quantifying and visualizing the plurality of green speeds, and a practice according to green lies may be performed.

Figure 11A:
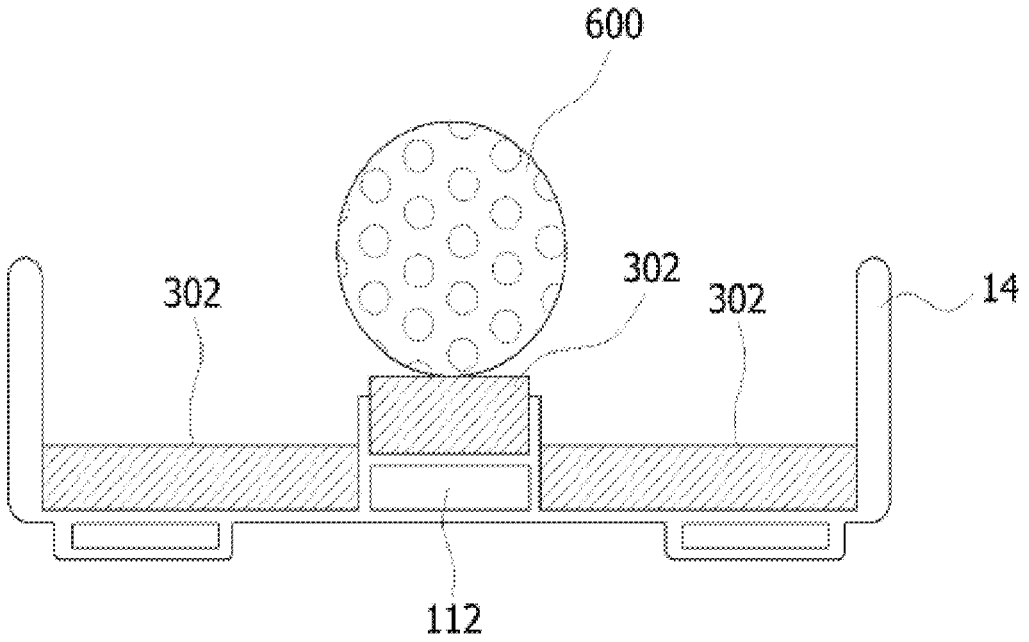
FIGS. 11A and 11B are cross-sectional views illustrating a state in which a ball is placed on artificial turf mounted on a body of the multipurpose putting practice device for enabling the straight putting and distance practice by situation according to the embodiment of the present invention.
Figure 11B:
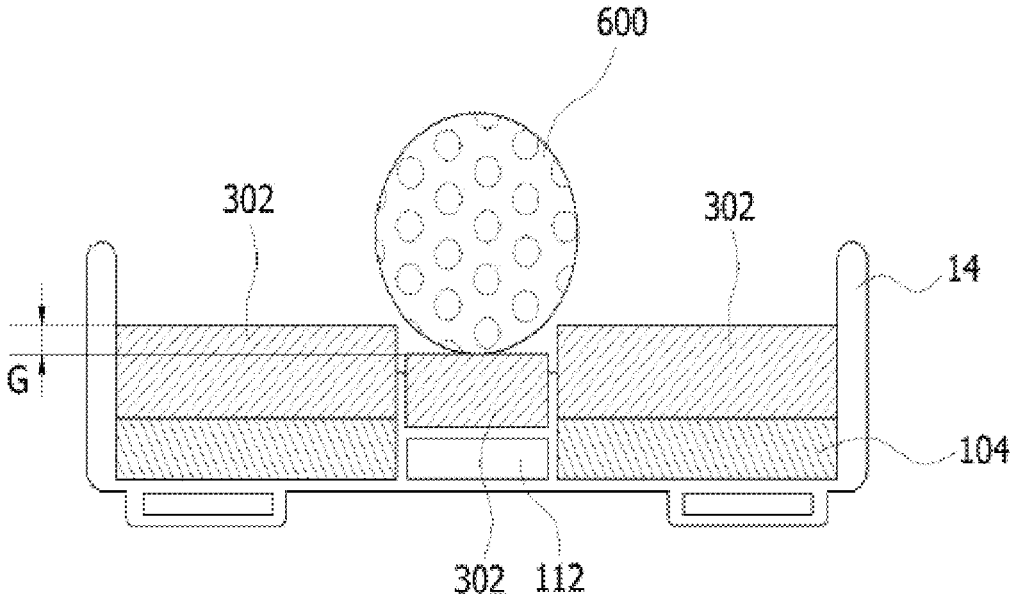

Meanwhile, FIGS. 11A and 11B are cross-sectional views illustrating states in which a ball is placed on artificial turf mounted on a body of the multipurpose putting practice device for enabling the straight putting and distance practice by situation according to the embodiment of the present invention, FIG. 11A is a cross-sectional view in a front view, and FIG. 11B is a cross-sectional view in a rear view.

In addition, artificial turf 302 is mounted on an upper surface of the putting line 12 formed in the center portion of the body 102, a ball 600 is positioned on an upper surface of the artificial turf 302, bottom bodies 10 are formed at lateral sides, and an upper surface distance G is formed between an upper surface of the putting line 12 and the bottom bodies 10 so that the ball 600 does not run in a lateral direction and is stably positioned.

The upper surface distance G between the upper surface of the putting line 12 and the bottom body 10 is preferable within a range of 1 to 3 mm.

First Embodiment

Figure 12:
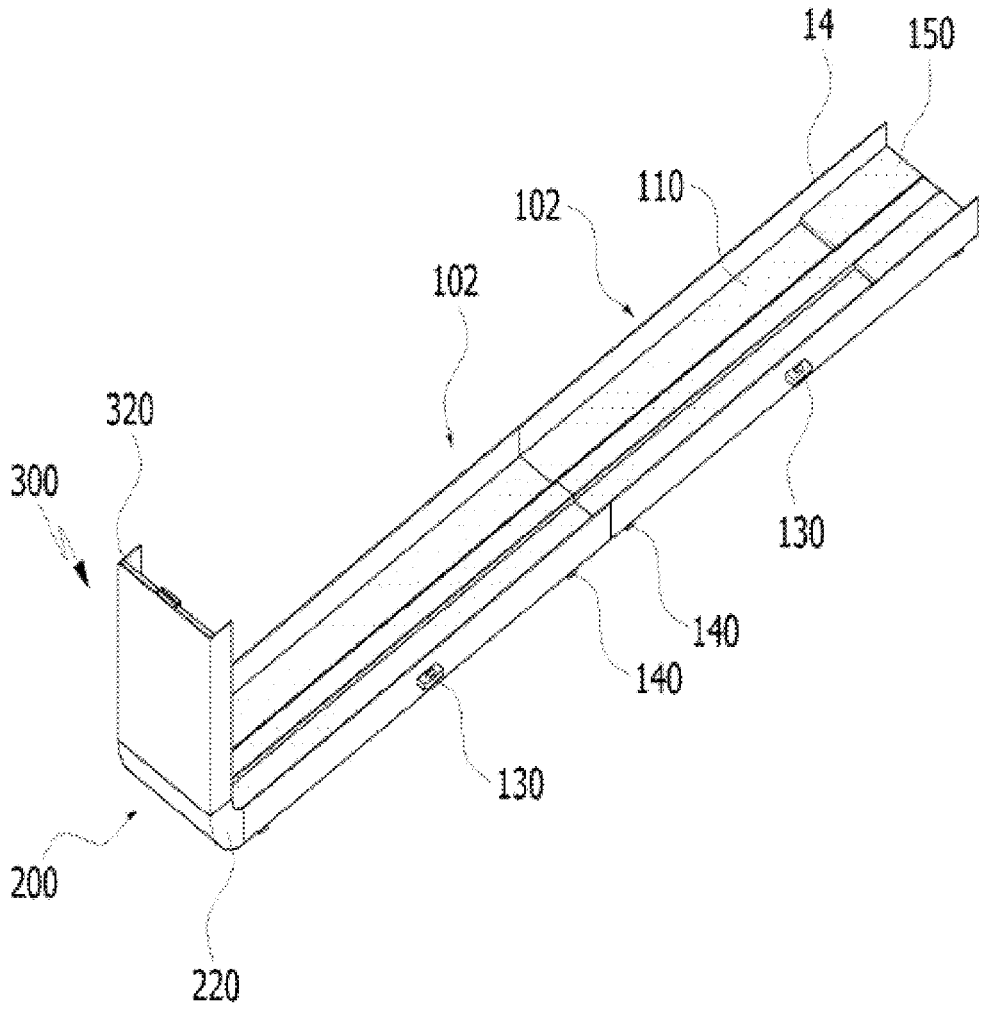
FIG. 12 is a view illustrating a multipurpose putting practice device for enabling straight putting and distance practice by situation according to another embodiment of the present invention.
Figure 13:
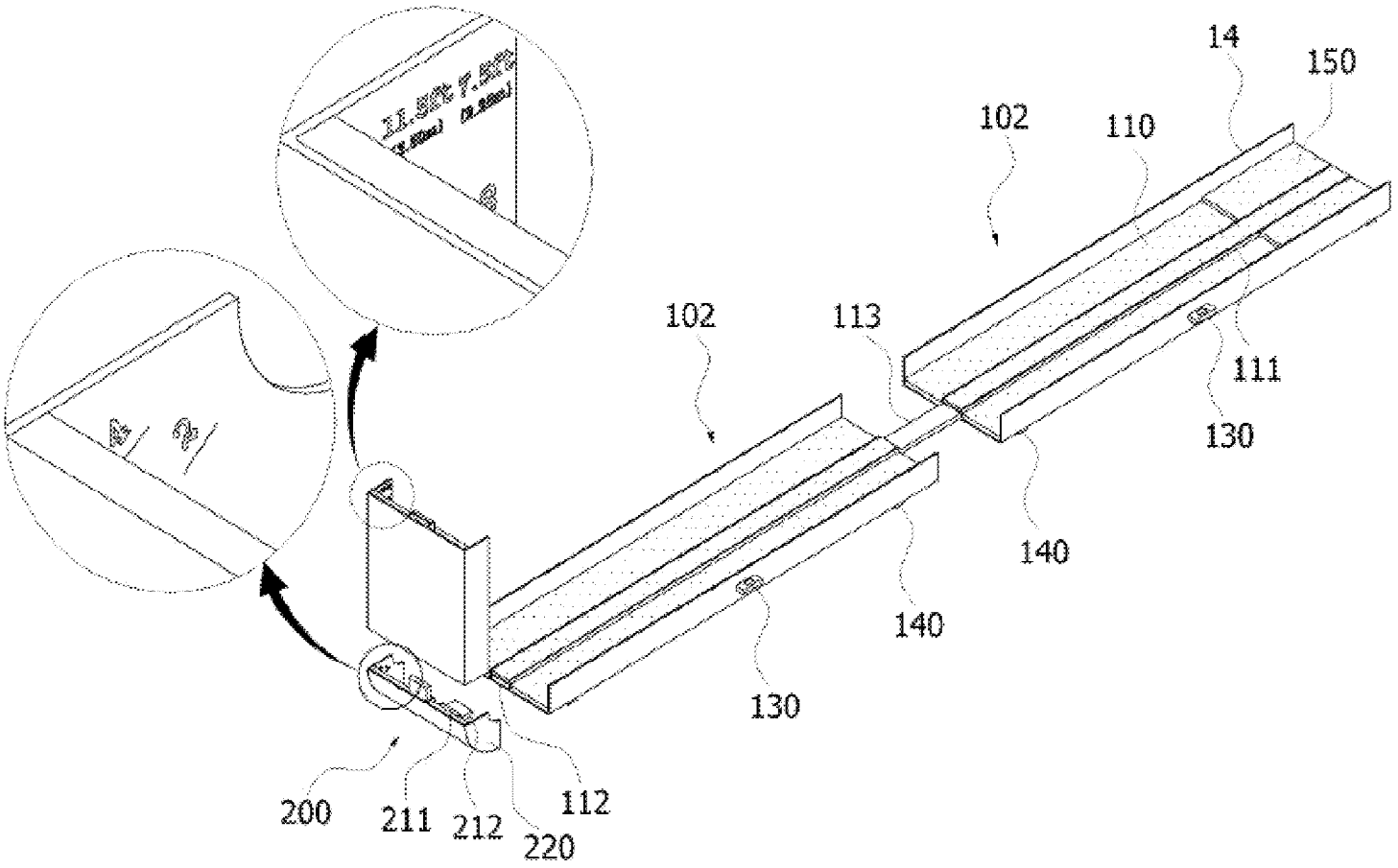
FIG. 13 is an exploded perspective view illustrating the multipurpose putting practice device for enabling the straight putting and distance practice by situation according to another embodiment of the present invention.
Figure 14:
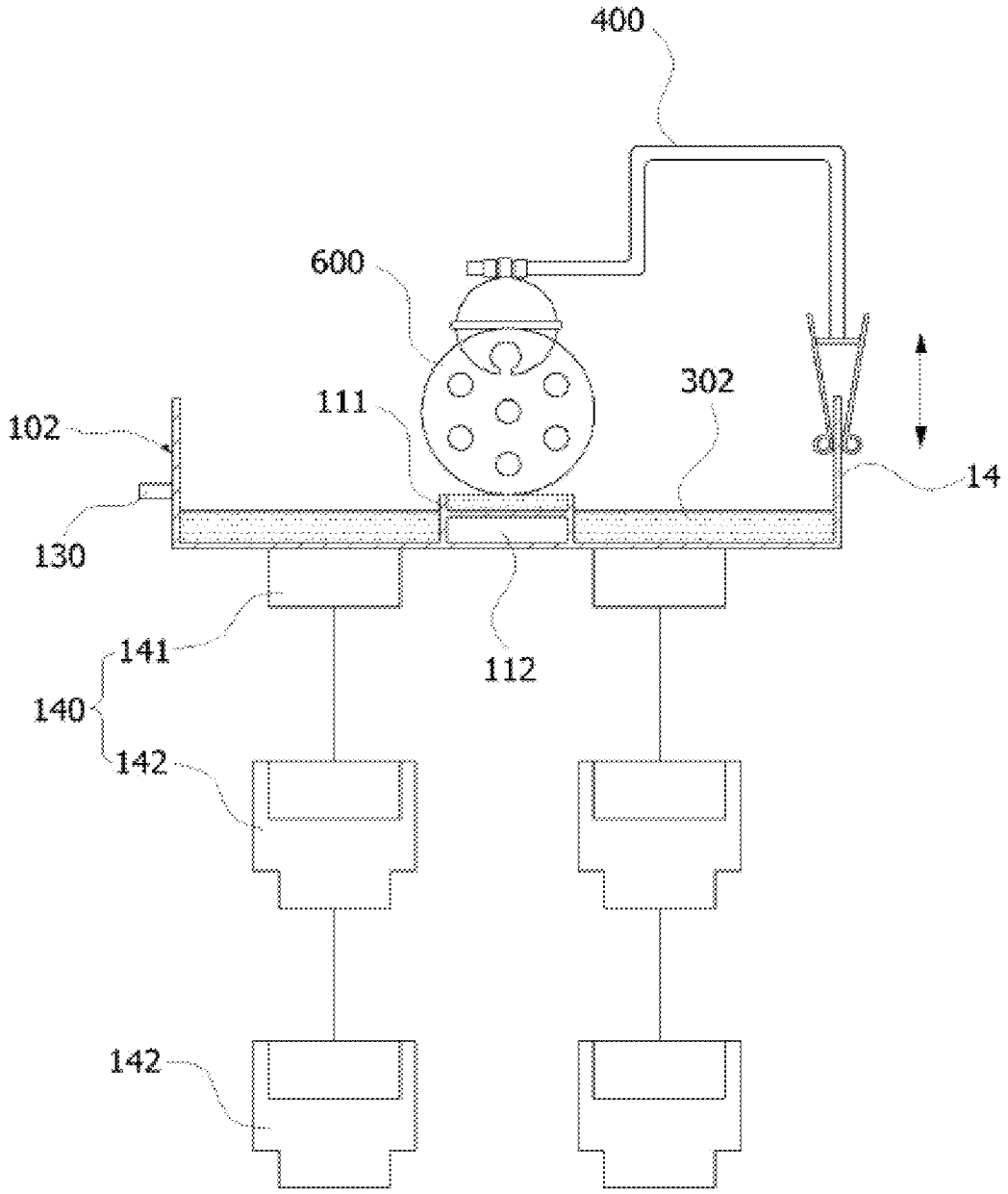
FIG. 14 is a cross-sectional view illustrating a body of the multipurpose putting practice device for enabling the straight putting and distance practice by situation according to another embodiment of the present invention.
Figure 15:
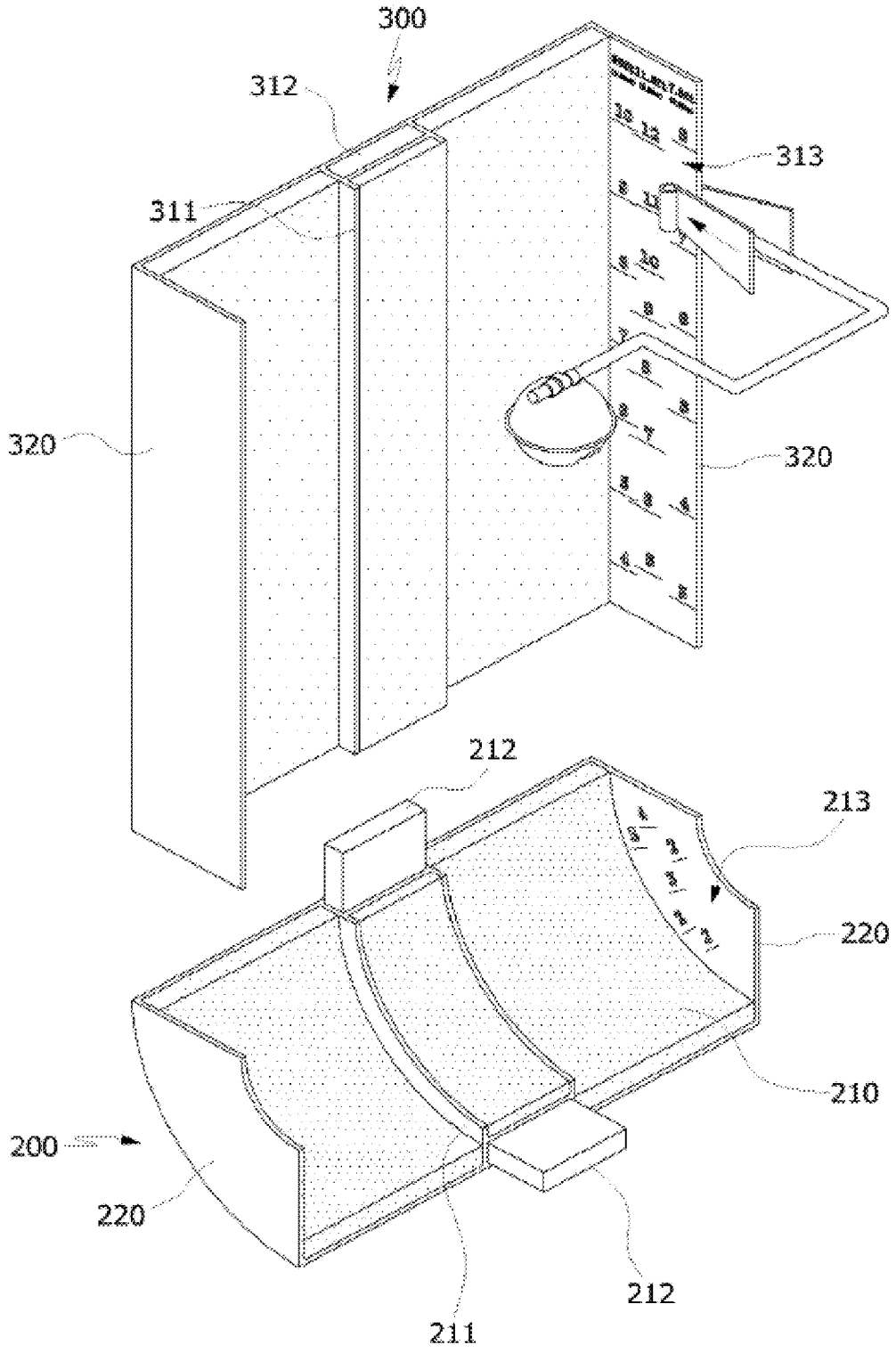
FIG. 15 is a view illustrating a connector and a vertical body of the multipurpose putting practice device for enabling the straight putting and distance practice by situation according to another embodiment of the present invention.
Figure 16:
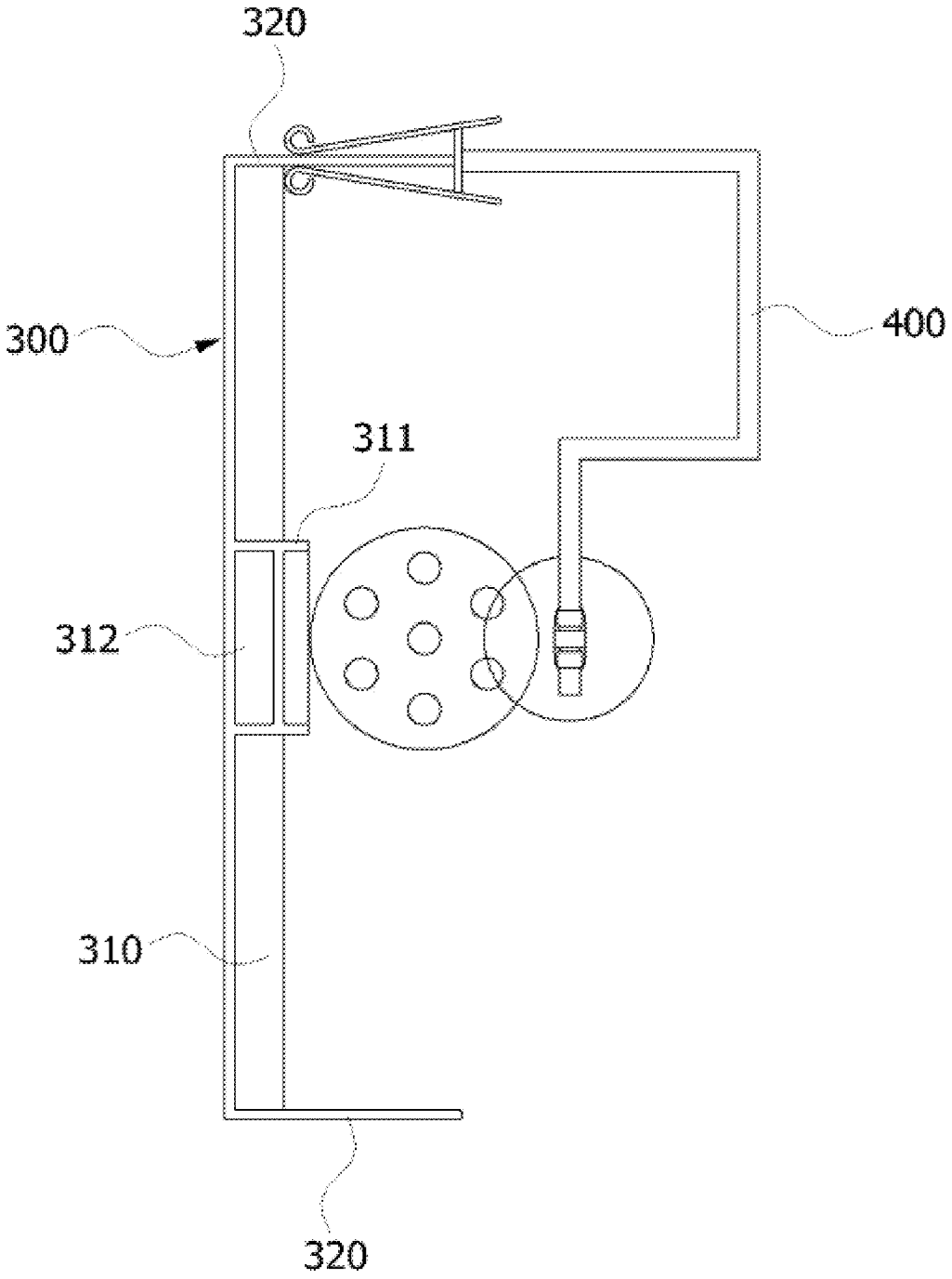
FIG. 16 is a cross-sectional view illustrating the vertical body of the multipurpose putting practice device for enabling the straight putting and distance practice by situation according to another embodiment of the present invention.

Subsequently, the multipurpose putting practice device for enabling the straight putting and distance practice by situation according to the embodiment of the present invention, as shown in FIGS. 12 to 14, includes a plurality of bodies 102 formed to protrude from the center of a putting line 111 which may be connected to each other.

As shown in FIGS. 12 and 13, the body 102 is formed with a bottom surface 110 formed to be flat, and sidewalls 14 perpendicularly formed on both ends of the bottom surface 110.

Here, the putting line 111 having a predetermined width is formed to protrude in a longitudinal direction in the center of the bottom surface 110 of the body 102, and thus a golf ball may run along the protruding putting line 111 up to a target point in a constant direction when a putting practice is performed, and a putting ability can be improved.

Spaces are formed at both sides of the bottom surface 110 of the body 102 based on the putting line 111 to run a golf ball separated from the putting line 111 when a putting practice is performed.

Further, sidewalls 14 are formed on both ends of the body 102 to prevent a departure of the golf ball to the outside of the body 102 when the golf ball runs.

Meanwhile, level determiners 130 which determine a level of the body 102 are preferably provided on side surfaces of the body 102 to determine whether the putting practice device according to the embodiment of the present invention is provided at a level position from a ground surface, and thus it takes the same effect as that generated by a practice performed on a flat lie of an actual field.

Further, height controllers 140 that control a height of the body 102 are preferably provided on a lower surface of the body 102 to adjust a level when the body 102 is not level from the ground surface, and in addition, a lie is formed on the putting practice device according to the embodiment of the present invention, and thus it takes the same effect as that generated by a practice performed on an uphill or downhill lie of an actual field.

As shown in FIG. 14, the height controllers 140 are formed with protrusions 141 formed to protrude in a downward direction in the front and rear of a lower surface of the body 102, and height control blocks 142 formed of a lumped mass having a predetermined height and having an insertion groove formed in an upper portion thereof into which the protrusion 141 is inserted. Here, a height of the height control block 142 is set to 5 cm.

Here, a lower portion of the height controller 140 is preferably formed to correspond to a shape of the protrusion 141, a plurality of height control blocks 142 may be preferably provided to be stackable with each other, and thus the height and lie of the body 102 may be controlled.

Meanwhile, as shown in FIGS. 12 and 13, the body 102 of the putting practice device according to the embodiment of the present invention is provided in a plural number, and the plurality of bodies 102 may be connected to each other, and thus a putting practice for a short distance and a medium distance may be performed.

Like this, in order to connect the bodies 102 to each other, as shown in FIGS. 13 and 14, the putting line 111 of the body 102 includes a through hole 112 formed in a longitudinal direction, and the bodies 102 are connected through an insertion bar 113 which is additionally provided.

That is, the bodies 102 in which the through hole 112 is formed are respectively positioned on both ends of the insertion bar 113, then the insertion bar 113 is inserted into the through hole 112 of the body 102 so as to connect the bodies 102.

Meanwhile, artificial turf or a carpet mat is preferably mounted on the putting line 111 and the bottom surface 110 of the body 102, and thus an environment similar to an actual field may be provided.

Further, separate departure preventing protrusions 150 are preferably mounted on both ends of the bottom surface 110 of the putting line 111 of the body 102, on which a putting practice is performed, so that a departure of a golf ball, which returns through the connector 200 after putting is performed, is prevented.

A connector 200 is additionally provided on an end of the body 102 in a longitudinal direction, and thus a golf ball may be collected when a putting practice is performed.

As shown in FIGS. 12 to 15, the connector 200 includes a bottom surface 210, sidewalls 220 are formed on both ends of the bottom surface 210 to prevent a departure of a golf ball to the outside, and a curved shape extending in an upward direction is preferably formed on an end of the bottom surface 210 corresponding to the front thereof, and thus when the golf ball hit on the body 102 reaches the connector 200 after putting is performed, the golf ball runs along the curved shape in an upward direction to collect position energy, then the position energy is converted into kinetic energy while the golf ball runs in a downward direction, and thus the golf ball runs to the body 102.

Here, an extending putting line 211 is preferably formed to protrude in a longitudinal direction in the center of the bottom surface 210 of the connector 200 so as to correspond to the putting line 111 of the body 102 and the vertical body 300.

Further, protruding bars 212 are formed on both ends of the extending putting line 211 of the connector 200, and are inserted into through holes 112 and 312 of the body 102 and the vertical body 300, which may be connected to each other.

Further, artificial turf or a carpet mat is also preferably mounted on the extending putting line 211 and the bottom surface 210 of the connector 200 similar to that on the body 102.

Meanwhile, a connector distance indicator 213, in which a plurality of green speeds are quantified, visualized and displayed, is preferably mounted on the connector sidewall 220.

The plurality of green speeds of the connector distance indicator 213 are green speeds by courses (4.5 ft to 10.5 ft) that are the announced green speeds of golf courses measured by Stimpmeter, which is a formal green speed gauge of USGA.

Like this, Stimpmeter, which is a green speed gauge, is used to measure the green speeds by courses on green turf, artificial turf, or a carpet mat.

Figure 17:
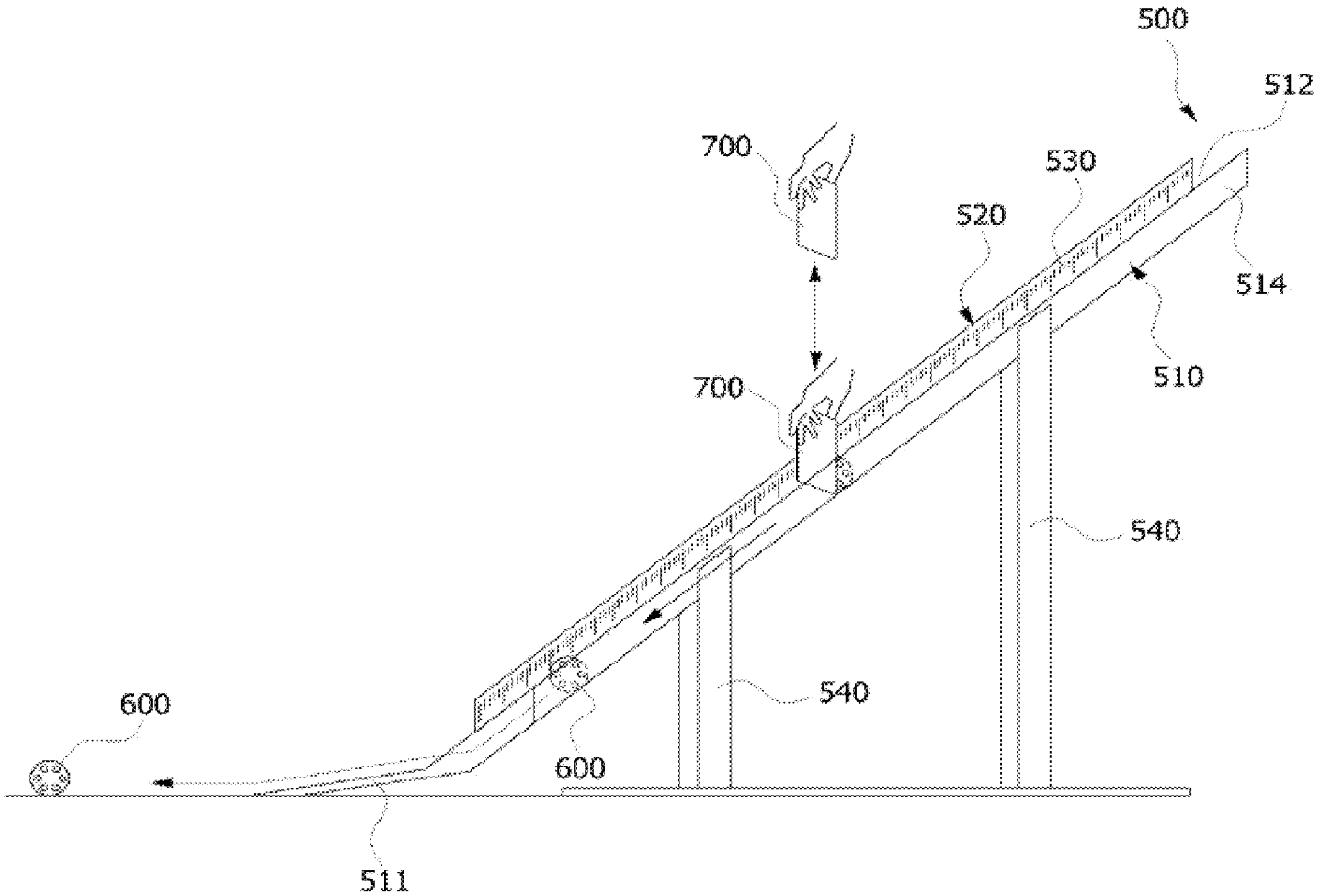
FIG. 17 is a view illustrating a distance gauge of the multipurpose putting practice device for enabling the straight putting and distance practice by situation according to another embodiment of the present invention.

Further, on the green turf, the artificial turf, or the carpet mat on which the green speeds by courses are measured, as shown in FIG. 17, when a gradation measuring gauge 700 supporting a golf ball is lifted upward at a height of specific location of a distance gauge 500 on which a distance indicating gradation 530 is mounted, the ball 600 freely falls along a lie of the distance gauge 500 and a measured value of the distance gauge 500, which is a run distance by meter (M) units, is separately recorded for each green speed by course.

Further, in the distance gauge 500, the gold ball runs on the putting practice device from a height of the measured value of the distance indicating gradation 530 separately recorded for each of the green speeds by courses, and positions by meters (M) are obtained. The connector distance indicator 213, which displays the positions by meters (M), is preferably mounted on connector sidewalls in a sticker type.

Like this, conventionally, a green speed is checked based on sensitivity, but the putting practice device is able to check the quantified green speeds by courses and to perform a practice.

Meanwhile, a bottom surface is vertically formed on an end of the center of the connector so that a practice for a medium and long distance may be performed, the sidewalls 220 for preventing a departure of a golf ball are formed on both ends of the bottom surface, and the vertical body 300 vertically in an upward direction is preferably and additionally provided on an end of the vertical surface.

Further, a putting line 311 of the vertical body 300 corresponding to the putting line 211 of the connector 200 is preferably formed to protrude in a longitudinal direction in the center of the vertical surface of the vertical body 300.

The through hole 312 of the putting line 311 of the vertical body 300 is formed and preferably connected to the through hole 112 through the protruding bar 212 of the connector.

Artificial turf or a carpet mat is preferably mounted on the putting line and the bottom surface of the above described vertical body.

Subsequently, a putting practice for a medium and long distance is possible through a vertical body distance indicators 313, which correspond to the connector distance indicators 213, on both sidewalls 320 of the vertical body, and it is preferable that sensitivity be trained by quantifying and visualizing distance practices by courses having different green speeds.

Here, the vertical body distance indicator 313 is measured and displayed using a method the same as that of the connector distance indicator 213, and values of the green speeds by courses are preferably displayed on the sidewalls 320 of the vertical body 300.

Referring to FIGS. 12, 13, 15, and 16, when a golf ball, on which straight putting is performed through the putting lines 111, 211, and 311, reaches a target distance of a course, a movable hole cup bell 400, which has a function similar to a hole-out of a hole cup in a field, is preferably and additionally provided.

Here, the movable hole cup bell 400 is preferably installed above the putting line 111, 211, and 311, through which a golf ball runs, to overlap an upper portion of a golf ball by a radius of the bell or less.

Further, the movable hole cup bell 400 is preferably installed at positions of the sidewalls 220 and 320, at which target distances of courses are displayed, using a clamp (or a press type holder) which is movably and easily installed, or using a circular steel wire which connects the bell and the holder.

The clamp (or the press type holder) may variously move in vertical and lateral directions and be fixed at a desired position.

Here, a height of a steel wire above the bottom surface is set so that an upper portion of a golf ball is not in contact with the steel wire, the circular steel wire is embedded in a bell ring so that energy generated by a straight run of the golf ball is transferred to the bell and converted into rotation energy through the circular steel wire after putting is performed, when the putting is performed with a stronger force than that required for a target distance, impact energy makes a rotation of the bell through the circular steel wire and this is helpful for a distance control practice due to being directly determinable by eye, and it is preferable to fix the bell by capping or welding so that the bell does not depart from an end of the wire by the impact.

Meanwhile, when the golf ball runs from the putting line 111 of the body to the vertical body putting line 311 through the connector 200, since a position of the bell of the vertical body is moved by a radius distance of the bell from the putting line by gravity, a holder in a clamp type may be preferably interlinked with and fixed on the sidewalls in consideration of the moving distance.

Further, after an arrow or the like is marked in the center of the clamp, the movable hole cup bell 400 is preferably set to a target distance of the connector distance indicator 213 and the vertical body distance indicator 313.

Like this, in the embodiment of the present invention, the plurality of bodies 102, in which the putting line 111 is formed to protrude from the center thereof, is provided and may be connected to each other so as to control a distance, and a lie control is possible through the height controller 140, and thus a putting practice for a short distance or medium and long distance may be performed in flat, uphill, and downhill environments and lies corresponding to actual fields can be experienced.

Further, by using the embodiment of the present invention, a golf ball runs up to a target point in a constant direction through the putting line 111, and thus directivity is improved when putting is performed, a correct putting posture may be maintained, and a distance control practice may be performed in a desired field by quantifying and visualizing the plurality of green speeds.

FIG. 17 is a view illustrating a distance gauge of the embodiment of the present invention.

A body 510 of a distance gauge 500 is obliquely installed on upper portions of pillars 540, and a bottom connector 511 is formed on a lower end of the body 510.

In the distance gauge 500, a cross section is formed in a concave-convex or channel shape, side films 514 are formed on both sides of the body 510, and a path 512 is formed in the center portion to downwardly run the ball 600.

Here, a distance indicator 520 is formed on an inner side of the side film 514 of one side surface of the body 510, and distance indicating gradations 530 are displayed on the distance indicator 520.

The distance indicating gradations 530 may measure and display a downward run distance of a ball along a lie using a gradation measuring gauge 700.

Figure 18:
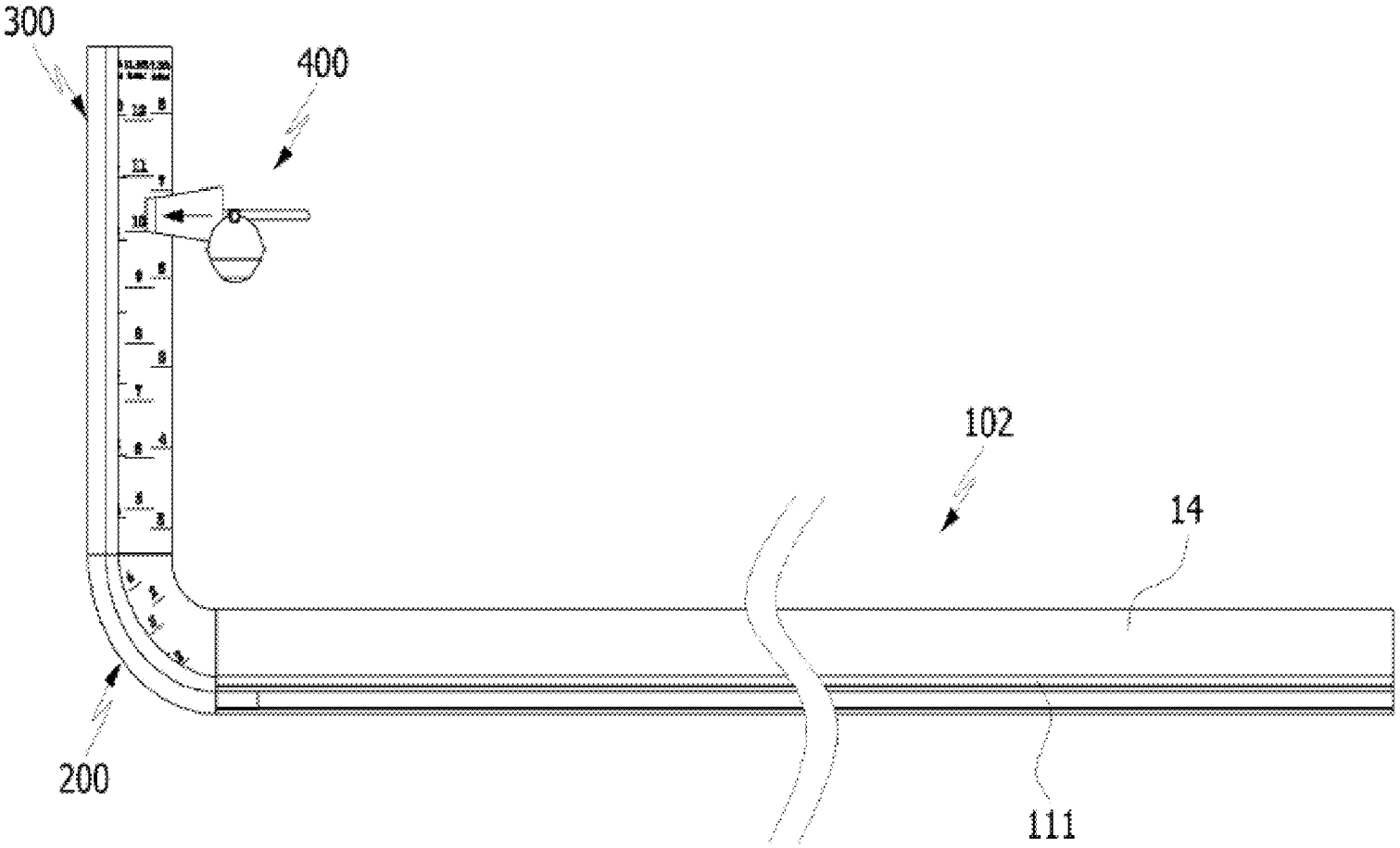
FIG. 18 is a cross-sectional view of FIG. 12.

FIG. 18 is a cross-sectional view of the putting practice device according to the embodiment of the present invention, and a cross-sectional view illustrating a state in which the connector distance indicator 213 and the vertical body distance indicator 313 are formed using display gradations measured by the distance gauge disclosed in FIG. 17.

Second Embodiment

As shown in FIGS. 19 to 22, the multipurpose putting practice device for enabling the straight putting and distance practice by situation according to the embodiment of the present invention includes a plurality of bodies 102, in which a putting line 111 is formed to protrude from the center thereof, and the bodies 102 may be connected to each other.

Figure 19:
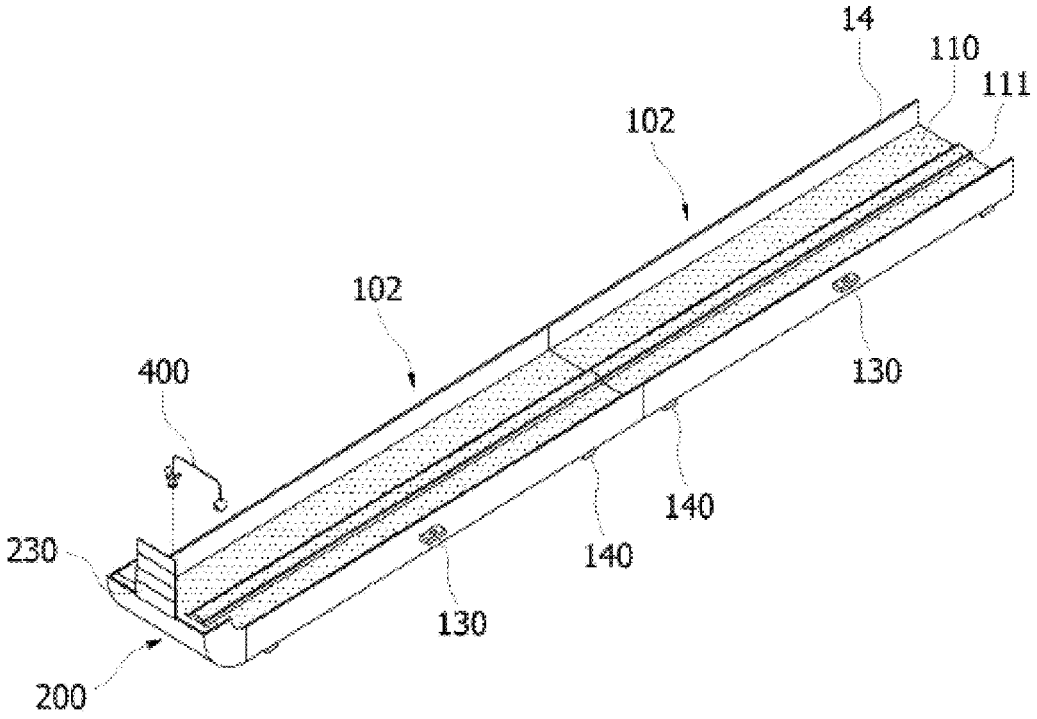
FIG. 19 is a view illustrating a multipurpose putting practice device for enabling straight putting and distance practice by situation according to one embodiment of the present invention.
Figure 20:
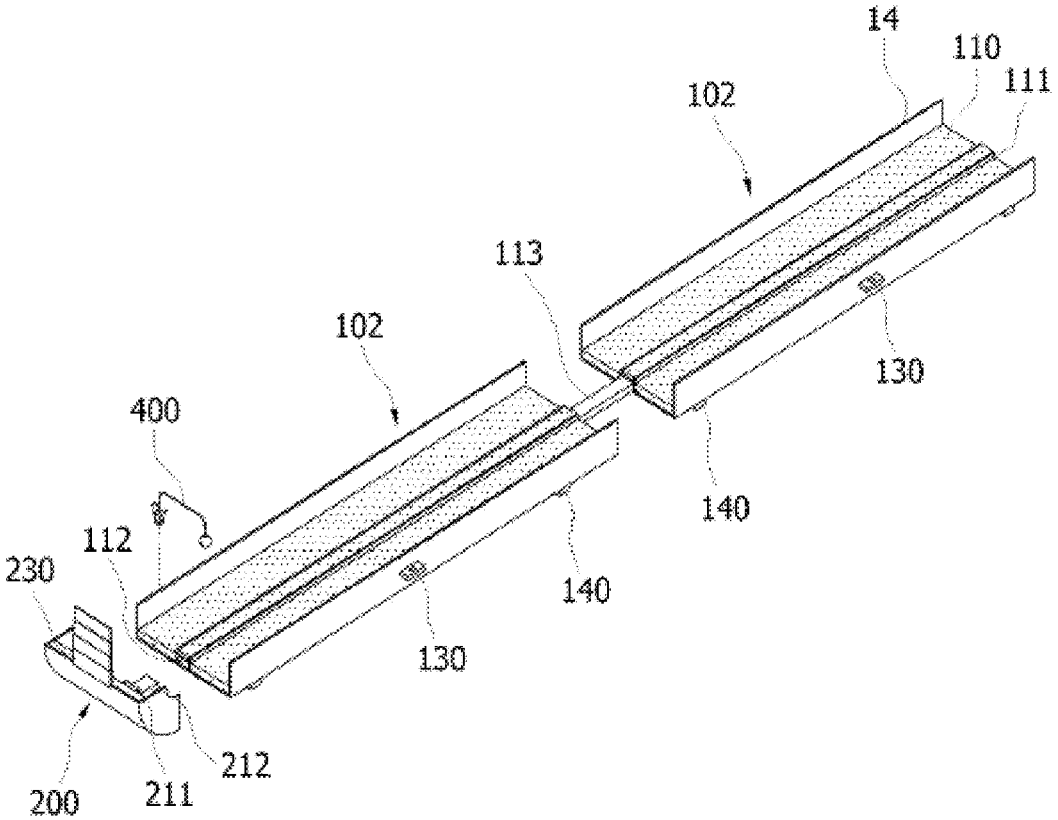
FIG. 20 is an exploded perspective view illustrating the multipurpose putting practice device for enabling the straight putting and distance practice by situation according to one embodiment of the present invention.

As shown in FIGS. 19 and 20, a body 102 is formed with a bottom surface 110 formed to be flat, and sidewalls 14 perpendicularly formed on both ends of the bottom surface 110.

Here, a putting line 111 having a predetermined width is formed to protrude in a longitudinal direction in the center of the bottom surface 110 of the body 102, and thus a golf ball may run along the protruding putting line 111 up to a target point in a constant direction when a putting practice is performed, and a putting ability can be improved.

Spaces are formed at both sides of the bottom surface 110 of the body 102 based on the putting line 111 to run a golf ball separated from the putting line 111 when a putting practice is performed.

Further, the sidewalls 14 are formed on both ends of the body 102 to prevent a departure of the golf ball to the outside of the body 102 when the golf ball runs.

Meanwhile, level determiners 130 that determine a level of the body 102 are preferably provided on side surfaces of the body 102 to determine whether the putting practice device according to the embodiment of the present invention is provided at a level position from a ground surface, and thus it takes the same effect as that generated by a practice performed on a flat lie of an actual field.

Further, height controllers 140 that control a height of the body 102 are preferably provided on a lower surface of the body 102 to adjust a level when the body 102 is not level from the ground surface, and in addition, a lie is formed on the putting practice device according to the embodiment of the present invention, and thus it takes the same effect as that generated by a practice performed on an uphill or downhill lie of an actual field.

Figure 22:
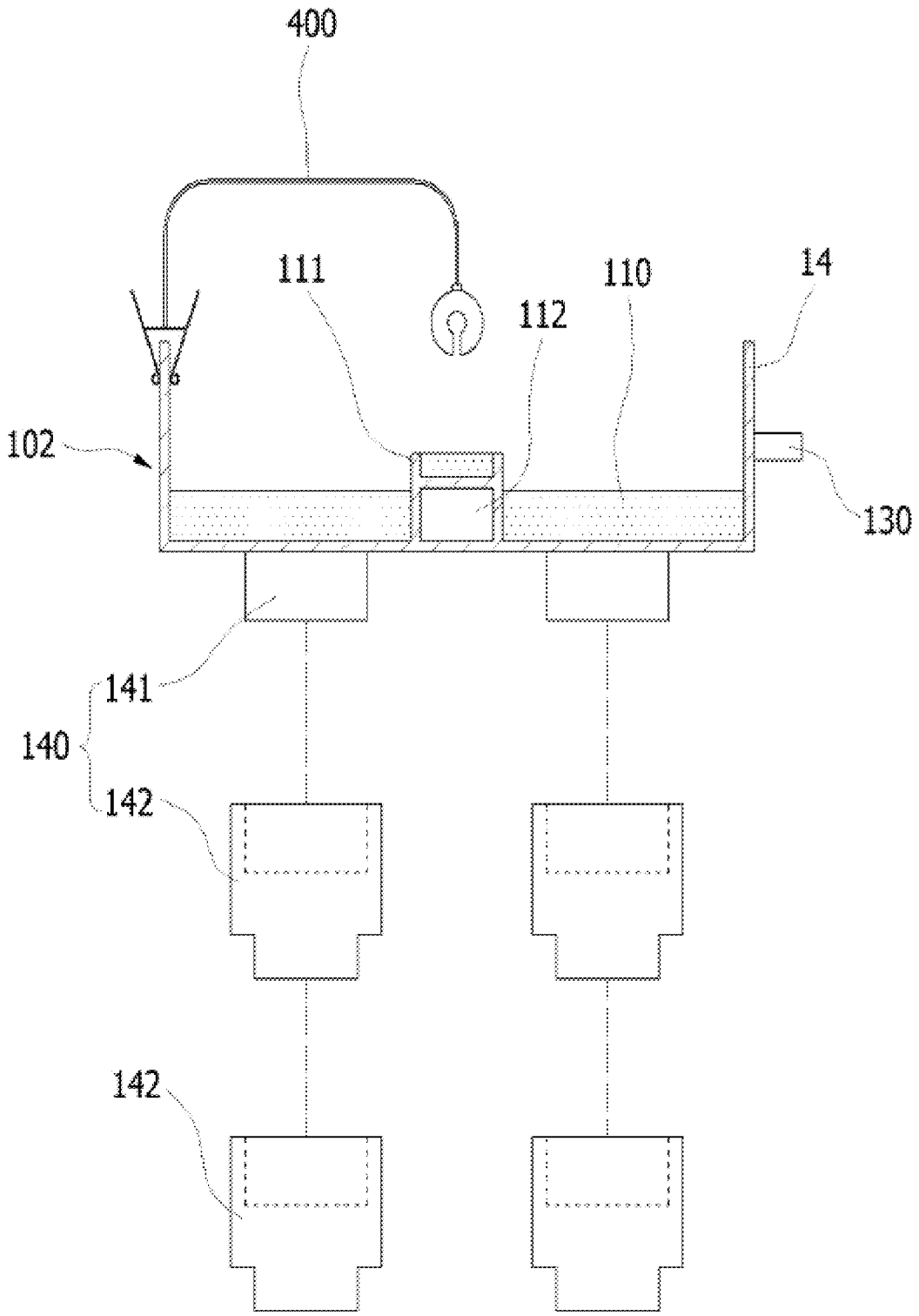
FIG. 22 is a side cross-sectional view illustrating a part of the multipurpose putting practice device for enabling the straight putting and distance practice by situation according to one embodiment of the present invention.

As shown in FIG. 22, the height controllers 140 are formed with protrusions 141 formed to protrude in a downward direction in the front and rear of a lower surface of the body 102, and height control blocks 142 formed of a lumped mass having a predetermined height and having an insertion groove formed in an upper portion thereof into which the protrusion 141 is inserted. Here, a height of the height control block 142 is set to 5 cm.

Here, a lower portion of the height controller 140 is preferably formed to correspond to a shape of the protrusion 141, a plurality of height control blocks 142 may be preferably provided to be stackable with each other, and thus the height and lie of the body 102 may be controlled.

Meanwhile, as shown in FIGS. 19 and 20, the body 102 of the putting practice device according to the embodiment of the present invention is provided in a plural number, and the plurality of bodies 102 may be connected to each other, and thus a putting practice for a short distance and a medium distance may be performed.

Like this, in order to connect the bodies 102 to each other, as shown in FIGS. 19 and 20, the putting line 111 of the body 102 include a through hole 112 formed in a longitudinal direction, and the bodies 102 are connected through an insertion bar 113 which is additionally provided.

That is, the bodies 102 in which the through hole 112 is formed are respectively positioned on both ends of the insertion bar 113, then the insertion bar 113 is inserted into the through hole 112 of the body 102 so as to connect the bodies 102.

Meanwhile, artificial turf or a carpet mat is preferably mounted on the putting line 111 and the bottom surface 110 of the body 102, and thus an environment similar to an actual field may be provided.

Further, different colors are preferably applied to the putting line 111 of the body 102 by predetermined units so that a user may measure a distance and distance sensitivity may be trained when a putting practice is performed.

A connector 200 is additionally provided on an end in a longitudinal direction of the body 102 to collect a golf ball when a putting practice is performed.

Figure 21:
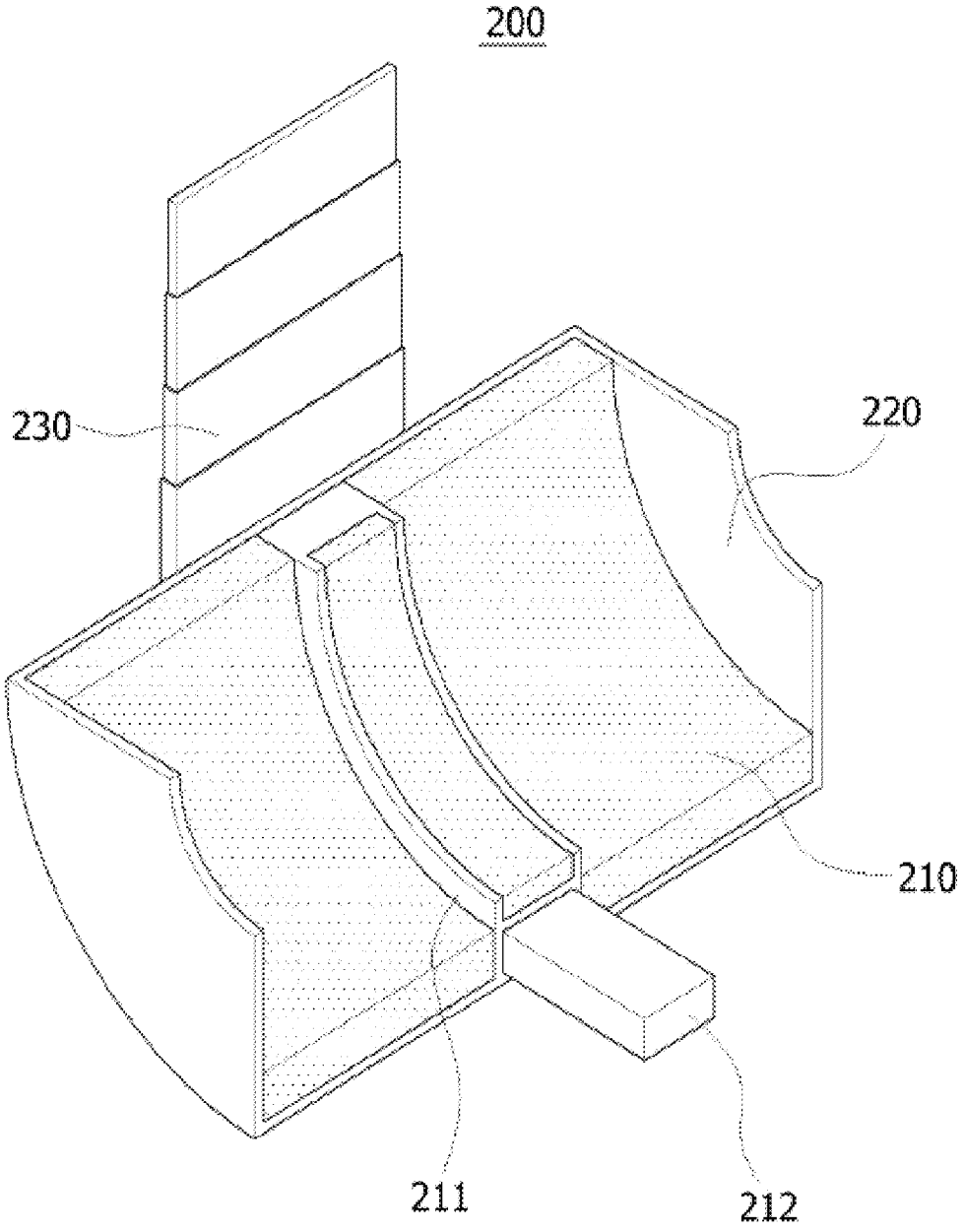
FIG. 21 is a view illustrating a connector of the multipurpose putting practice device for enabling the straight putting and distance practice by situation according to one embodiment of the present invention.

As shown in FIGS. 19 to 21, the connector 200 includes a bottom surface 210, sidewalls 220 are formed on both ends of the bottom surface 210 to prevent a departure of a golf ball to the outside, and a curved shape extending in an upward direction is preferably formed on an end of the bottom surface 210 corresponding to the front thereof, and thus when a golf ball hit on the body 102 reaches the connector 200 after putting is performed, the golf ball runs along the curved shape in an upward direction to collect position energy, then the position energy is converted into kinetic energy while the golf ball runs in a downward direction, and thus the golf ball runs to the body 102.

Here, an extending putting line 211 is preferably formed to protrude in a longitudinal direction in the center of the bottom surface 210 of the connector 200 so as to correspond to the putting line 111 of the body 102 and the vertical body 300.

Further, a protruding bar 212 is formed on the extending putting line 211 of the connector 200 in a bodily direction, the connector 200 is inserted into a through hole 112 of the putting line 111 of the body 102 so that the connector 200 and the body 102 may be connected to each other.

Further, artificial turf or a carpet mat is also preferably mounted on the extending putting line 211 and the bottom surface 210 of the connector 200 similar to that on the body 102.

Further, different colors are applied to the extending putting line 211 of the connector 200 in a vertical direction by 2M units so that a user may measure a distance and distance sensitivity may be trained when a putting practice is performed.

Here, a drawer vertical extension bar 230is preferably added to the connector 200, to which different colors are applied to the end of the center of the bottom surface 210 thereof in a vertical direction by 2M units, so that putting for a medium and long distance may be performed in a narrow indoor space.

Meanwhile, a bell is preferably tied onto an end of a pillar of folding type that is connected to the body sidewalls 14 and the connector sidewall 220 using a clamp or a pressing rubber and may freely change a shape thereof, and thus a movable hole cup bell 400 is added at a desired distance position above the putting line 111, the extending putting line 211, or the vertical extension bar 230 so that a distance sensitivity may be obtained without being boring.

Like this, in the embodiment of the present invention, the plurality of bodies 102, in which the putting line 111 is formed to protrude from the center thereof, is provided and may be connected to each other so as to control a distance, and a lie control is possible through the height controller 140, and thus a putting practice for a short distance or medium and long distance may be performed in flat, uphill, and downhill environments, lies corresponding to actual fields can be experienced, and a level of user satisfaction may be improved.

Further, by using the embodiment of the present invention, a golf ball runs up to a target point in a constant direction through the putting line 111, and thus directivity is improved when putting is performed, a correct putting posture may be maintained, and there is an advantage of being able to control a direction and distance.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A multipurpose putting practice device for enabling straight putting and distance practice by situation, comprising:

a body (102) including a bottom body (10) having a putting line (12) formed to protrude therefrom, sidewalls (14) formed on both sides thereof, a level determiner (106) which controls a lateral level, and a departure preventer (104) provided on a rear end of one side thereof;

a connector (200) inserted into and coupled with a front end of the body (102), including a connector putting line (30) formed to be connected to the putting line (12) so that a ball (600) runs in an upward direction, and including connector distance indicators (122 and 124);

a vertical body (300) inserted into and coupled with an upper portion of the connector (200), including a vertical body putting line (42) formed to be connected to the connector putting line (30) so that the ball (600) runs in an upward direction, and including vertical body distance indicators (116 and 118); and a hole-out determiner (120) installed in a lateral direction at the connector (200) or the vertical body (300), positioned at the connector putting line (30) or the vertical body putting line (42), and including a hole-out determination bell (62) which determines whether the ball (600) is entered into a hole cup by a sound when the ball (600) is in contact therewith after putting is performed, wherein a putting practice is performable according to a green speed, a flat level, and a lie.

2. The multipurpose putting practice device of claim 1, wherein the level determiner (106) includes a leveler.

3. The multipurpose putting practice device of claim 2, wherein the leveler includes a body leveler (15) installed on the body (102) and a vertical body leveler (19) installed on the vertical body (300) to determine a level of the putting line (12) and the vertical body putting line (42).

4. The multipurpose putting practice device of claim 1, wherein a plurality of lie controllers (108), which are formed to be vertically lifted and adjust a height of the body (102) to control a lie, are installed under the body (102).

5. The multipurpose putting practice device of claim 4, wherein the lie controller (108) includes:

a fixed body (20) in which a male screw portion fixed into a lower portion of the body (102) is formed; and a coupler (26) to which the fixed body (20) is screw-coupled.

6. The multipurpose putting practice device of claim 1, wherein the vertical body (300) includes a vertical departure preventer (114) having an insertion coupler (50) inserted into and coupled with an upper end of the vertical body (300) so that the ball (600) does not depart in an upward direction and returns after the putting is performed.

7. The multipurpose putting practice device of claim 6, wherein the vertical departure preventer (114) is coupled with a body (40) of the vertical body (300) and includes an insertion coupler (50) coupled with and installed to cover upper portions of the vertical body distance indicators (116 and 118).

8. The multipurpose putting practice device of claim 1, wherein the vertical body (300) includes a body (40) of the vertical body (300) formed with a rectangular plate, wherein the vertical body putting line (42) formed to protrude from the center of the body (40) of the vertical body (300) in a long shape is formed, and both sides of the body (40) of the vertical body (300) are provided with a vertical body distance indicator (116) on which distance indicating gradations (44) are formed and a vertical body distance indicator (118) on which distance indicating gradations (46) are formed.

9. The multipurpose putting practice device of claim 8, wherein an upper departure body (48) which connects the vertical body distance indicator (116) and the vertical body distance indicator (118) is provided on an upper portion of the body (40) of the vertical body (300), and is formed to protrude in a forward direction.

10. The multipurpose putting practice device of claim 8, wherein the distance indicating gradations (44) display target distance gradations by meters (m), distance gradations by feet (ft), and target distance gradations by uphill and downhill lies for amateurs.

11. The multipurpose putting practice device of claim 8, wherein the distance indicating gradations (46) display target distance gradations by meters (m), distance gradations by feet (ft), and target distance gradations by uphill and downhill lies for professionals.

12. The multipurpose putting practice device of claim 1, wherein the hole-out determiner (120) includes:

a clamp (121) inserted into and coupled with a body (40) of the vertical body (300) and a connector body (28) and including a gradation determination window (56) which determines a distance;

a holder (58) which extends from one side end of the clamp (121) and is formed to be bent; and a rotatable hinge part (123) through which the hole-out determination bell (62) is connected to a center portion of the holder (58) to be rotatable.

13. The multipurpose putting practice device of claim 12, wherein the clamp (121) is formed with a rectangular clamp body (52) and a gradation determination body (54), wherein the gradation determination window (56) is formed on one side surface of each of the clamp body (52) and the gradation determination body (54) to display distance indicating gradations (44 and 46) formed on inner and outer side surfaces of the vertical body distance indicators (116 and 118) and distance indicating gradations (76 and 78) formed on inner and outer side surfaces of the connector distance indicators (122 and 124).

14. The multipurpose putting practice device of claim 12, wherein the rotatable hinge part (123) is formed with a position holder (64) formed in the center portion of the holder (58), and a fixed protrusion (60) of the hole-out determination bell (62), and the hole-out determination bell (62) makes a sound and rotates about the position holder (64).

* * * * *